US006942321B2

(12) United States Patent
Kubota et al.

(10) Patent No.: US 6,942,321 B2
(45) Date of Patent: Sep. 13, 2005

(54) METHOD FOR PRODUCING LIQUID DISCHARGE HEAD

(75) Inventors: Masahiko Kubota, Tokyo (JP); Wataru Hiyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 133 days.

(21) Appl. No.: 10/615,143

(22) Filed: Jul. 9, 2003

(65) Prior Publication Data

US 2004/0027422 A1 Feb. 12, 2004

(30) Foreign Application Priority Data

Jul. 10, 2002 (JP) ..... 2002-201876

(51) Int. Cl.[7] ..... B41J 2/045
(52) U.S. Cl. ..... 347/71
(58) Field of Search ..... 347/102, 101, 347/86, 85, 84, 70–72, 61–65, 47, 20, 1, 5, 7, 9

(56) References Cited

U.S. PATENT DOCUMENTS

| | | | |
|---|---|---|---|
| 4,558,333 | A | 12/1985 | Sugitani et al. |
| 4,882,595 | A | 11/1989 | Trueba et al. |
| 5,278,584 | A | 1/1994 | Keefe et al. |
| 5,478,606 | A | 12/1995 | Ohkuma et al. |
| 6,158,843 | A | 12/2000 | Murthy et al. |
| 6,303,274 | B1 | 10/2001 | Chen et al. |
| 6,334,670 | B1 | 1/2002 | Yoshihira et al. |
| 6,488,364 | B1 | 12/2002 | Nakajima et al. |
| 6,491,381 | B2 | 12/2002 | Mochizuki et al. |
| 6,491,834 | B1 | 12/2002 | Kubota et al. |
| 2002/0071006 | A1 | 6/2002 | Chen et al. |

FOREIGN PATENT DOCUMENTS

| | | | |
|---|---|---|---|
| EP | 0517399 | A1 | 12/1992 |
| EP | 0734866 | * | 2/1996 |
| EP | 0867292 | A2 | 9/1998 |
| EP | 1005986 | A1 | 6/2000 |
| JP | 54-161935 | A | 12/1979 |
| JP | 61-185455 | A | 8/1986 |
| JP | 61-249768 | A | 11/1986 |
| JP | 4-10940 | | 1/1992 |
| JP | 4-10941 | | 1/1992 |
| JP | 2000-255072 | | 9/2000 |

* cited by examiner

*Primary Examiner*—Raquel Yvette Gordon
(74) *Attorney, Agent, or Firm*—Fitzpatrick, Cella, Harper & Scinto

(57) ABSTRACT

The invention is to provide a liquid discharge head capable of achieving a higher liquid droplet discharge speed and a more stable discharge amount, thereby improving the discharge efficiency, and a producing method therefor. A liquid discharge head 1 includes a heater 20, an element substrate 11, a nozzle 27 including a discharge port portion 26 having a discharge port 26*a* for discharging a liquid droplet, a bubble generating chamber and a supply path for supplying the bubble generating chamber with the liquid, and an orifice substrate 12 including a supply chamber 28 for supplying the nozzle 27 with the liquid, wherein the bubble generating chamber is constituted of a first bubble generating chamber 31*a* and a second bubble generating chamber 31*b* provided thereon, the discharge port portion 26 is provided on and communicates with the second bubble generating chamber with a step difference thereto, the lateral wall of the second bubble generating chamber 32*b* is constricted toward the discharge port with an inclination of 10° to 45°, and the upper plane of the supply path is formed higher toward the supply chamber, in order to increase the liquid amount in the supply path and to improve the temperature dependence of the discharge amount.

5 Claims, 14 Drawing Sheets

METHOD FOR PRODUCING LIQUID DISCHARGE HEAD

BACKGROUND OF THE INVENTION

1. Field of the Invention

The present invention relates to a method for producing a liquid discharge head for discharging a liquid droplet such as an ink droplet, thereby forming a record on a recording medium, and more particularly to a method for producing a liquid discharge head for ink jet recording.

2. Description of the Related Art

The ink jet recording method is one of the so-called non-impact recording methods. Such an ink jet recording method generates almost negligible noise during recording and is capable of high speed recording. Also the ink jet recording method is capable of recording on various recording media and achieving ink fixation even on so-called plain paper to provide a high definition image inexpensively. Based on these advantages, the ink jet recording method has become widespread recently not only in a printer constituting peripheral computer equipment, but also as recording means for a copying machine, a facsimile apparatus, a word processor, etc.

For achieving ink discharge in the commonly utilized ink jet recording method, methods of employing, as an element for generating a discharge energy to be used for discharging an ink droplet, an electrothermal converting element such as a heater or an electromechanical converting element such as a piezo element are known. The discharge of the ink droplet can be controlled by an electrical signal in either method. The ink discharging method employing the electrothermal converting element is based on a principle of applying a voltage to the electrothermal converting element, thereby causing the ink in the vicinity of the electrothermal converting element to boil instantaneously and discharging an ink droplet at a high speed by a rapid growth of a bubble generated by a phase change in the ink at boiling. On the other hand, the ink discharge method utilizing the piezoelectric element is based on a principle of applying a voltage to the piezoelectric element, thereby causing a displacement therein and discharging an ink droplet by a pressure generated by such displacement.

The ink discharge method utilizing the electrothermal converting element has advantages of not requiring a large space for providing the discharge energy generating element and of a simple structure of the liquid discharge head, enabling easy integration of nozzles. On the other hand, such an ink discharge method is associated with drawbacks specific to this method, such as a fluctuation in the volume of the flying ink droplet by an accumulation in the liquid discharge head of the heat generated by the electrothermal converting element, a detrimental influence of a cavitation phenomenon caused by the extinction of the bubble on the electrothermal converting element, and a detrimental influence of air dissolved in the ink, forming bubbles remaining in the liquid discharge head and influencing the discharge characteristics of the ink droplet and the quality of the obtained image.

For solving these problems, Japanese Patent Application Laid-open Nos. 54-161935, 61-185455, 61-249768, and 4-10941 disclose an ink jet recording method and a liquid discharge head. The ink jet recording method disclosed in these references has a configuration in which a bubble, generated by driving an electrothermal converting element with a recording signal, is made to communicate with the external air. Such an ink jet recording method enables the stabilization of the volume of the flying ink droplet, the discharge of an ink droplet of an extremely small volume at a high speed, and the elimination of the cavitation at the extinction of the bubble thereby improving the durability of the heater, thus allowing easier obtainment of an image of a higher definition. The aforementioned references disclose a configuration, for causing the bubble to communicate with the external air, in which a minimum distance between an electrothermal converting element and a discharge port is significantly reduced in comparison with a prior configuration.

Now there will be explained such a prior liquid discharge head. A prior liquid discharge head is provided with an element substrate on which an electrothermal converting element for ink discharge is provided and an orifice substrate for constituting an ink flow path by being adjoined to the element substrate. The orifice substrate has plural discharge ports for discharging ink, plural nozzles in which the ink flows, and a supply chamber for supplying such nozzles with the ink. A nozzle is constituted of a bubble generating chamber for generating a bubble in the ink therein by an electrothermal converting element and a supply path for supplying the bubble generating chamber with the ink. The element substrate is provided with an electrothermal converting element so as to be positioned in the bubble generating chamber. The element substrate is also provided with a supply aperture for supplying the supply chamber with the ink from a rear surface opposite to a principal plane adjacent to the orifice substrate. Also, the orifice substrate is provided with a discharge port in a position opposed to the electrothermal converting element provided on the element substrate.

In the prior liquid discharge head of the above-described configuration, the ink supplied from the supply aperture to the supply chamber is supplied along each nozzle and is filled in the bubble generating chamber. The ink filled in the bubble generating chamber is caused to fly, by a bubble generated by a film boiling caused by the electrothermal converting element, in a direction substantially perpendicular to the principal plane of the element substrate and is discharged from the discharge port.

In a recording apparatus equipped with the aforementioned liquid discharge head, a higher recording speed is being investigated for achieving a higher quality, a higher definition and a higher resolution in the recorded image. For increasing the recording speed in the prior recording apparatus, U.S. Pat. Nos. 4,882,595 and 6,158,843 disclose a method of increasing a number of discharges of the flying ink droplets in each nozzle of the liquid discharge head, namely increase a discharge frequency.

In particular, U.S. Pat. No. 6,158,843 proposes a configuration of improving the ink flow from the supply aperture to the supply path, by providing a space for locally constricting the ink flow path and a projection-shaped fluid resistance element in the vicinity of the supply aperture.

However, in the aforementioned prior liquid discharge head, at the discharge of an ink droplet, the bubble grown in the bubble generating chamber pushes back a part of the ink in the bubble generating chamber into the supply path. For this reason, the prior liquid discharge head is associated with a drawback that a discharge amount of the ink droplet decreases as a result of a decrease in the ink volume in the bubble generating chamber.

Also in the prior liquid discharge head, when a part of the ink in the bubble generating chamber is pushed back toward the supply path, a part of the pressure of the growing bubble at the side of the supply path escapes into the supply path, or a pressure loss is generated by a friction between an internal wall of the bubble generating chamber and the bubble. For this reason, the prior liquid discharge head is associated with a drawback of a reduced discharge speed of the ink droplet as a result of a reduction of the bubble pressure.

Furthermore, in the prior liquid discharge head, because the volume of the ink of a very small amount filled in the bubble generating chamber varies by the bubble growing in the bubble generating chamber, there results a drawback of a fluctuation in the discharge amount of the ink droplet.

SUMMARY OF THE INVENTION

In consideration of the foregoing, an object of the present invention is to provide a liquid discharge head capable of achieving a higher discharge speed of a liquid droplet and stabilizing a discharge amount of the liquid droplet, thereby improving a discharge efficiency for the liquid droplet, and a producing method therefor.

The above-mentioned object can be attained, according to the present invention, by a method for producing a liquid discharge head including a discharge energy generating element for generating energy for discharging a liquid droplet, an element substrate provided with the discharge energy generating element on a principal plane thereof, and an orifice substrate provided with a discharge port portion including a discharge port for discharging a liquid droplet, a bubble generating chamber for generating a bubble in a liquid therein by the discharge energy generating element, a nozzle including a supply path for supplying the bubble generating chamber with the liquid, and a supply chamber for supplying the nozzle with the liquid, and adjoined to the principal plane of the element substrate, the method including a step of coating, on the element substrate in which the aforementioned discharge energy generating element is provided on the principal plane, a solvent-soluble thermally crosslinkable organic resin for forming a pattern of a first bubble generating chamber and a first flow path and heating the resin thereby forming a thermally crosslinked film; a step of coating, on the thermally crosslinked film, a solvent-soluble organic resin for forming a pattern of a second bubble generating chamber and a second flow path; a step of forming, in the aforementioned organic resin, a second flow path pattern of a smaller height than in the second bubble generating chamber simultaneously with a pattern of the second bubble generating chamber, by employing a locally different exposure amount; a step of laminating a negative-working organic resin layer on the thermally crosslinked film and the patterned organic resin and forming the aforementioned discharge port portion in the negative-working organic resin layer; and a step of removing the thermally crosslinked film and the patterned organic resin.

The pattern of the second flow path may be formed by an exposure and a development of an organic resin, employing a slit mask having a slit pitch. The pattern of the second bubble generating chamber and the second flow path may be formed, after an exposure through a mask and a development, by a formation of a slope of 10° to 45° by the application of a temperature. Also the second flow path pattern may be formed with two or more step differences by an exposure and a development of the organic resin, utilizing a mask having different slit pitches.

The liquid discharge head thus obtained is so constructed that a flow path within a nozzle varies in a height, a width or a cross-section and that an ink volume gradually decreases in a direction from the substrate to the discharge port, and a vicinity of the discharge port is so constructed that a flying liquid droplet flies perpendicularly to the substrate and that a flow rectifying effect is realized. Also at the discharge of a liquid droplet, it is possible to suppress a push-out of the liquid in the bubble generating chamber by the bubble generated therein toward the supply path. Therefore, such a liquid discharge head can suppress the fluctuation in the discharge volume of the liquid droplet discharged from the discharge port, thereby securing an appropriate discharge volume. Also in this liquid discharge head, at the discharge of a liquid droplet, because of a presence of a control portion constituted by a step difference portion, the bubble growing in the bubble generating chamber comes into contact with an internal wall of the control portion in the bubble generating chamber, whereby a pressure loss of the bubble can be suppressed. Therefore, such liquid discharge head allows satisfactory growth of the bubble in the bubble generating chamber to ensure a sufficient pressure, thereby improving the discharge speed of the liquid droplet.

BRIEF DESCRIPTION OF THE DRAWINGS

FIGS. 8A, 8B, 8C, 8D and 8E are perspective views showing a method for producing the liquid discharge head of the first embodiment of the present invention, wherein FIG. 8A shows an element substrate; FIG. 8B shows a state where a lower resin layer and an upper resin layer are formed on the element substrate; FIG. 8C shows a state where a covering resin layer is formed; FIG. 8D shows a state where a supply aperture is formed; and FIG. 8E shows a state where internal lower and upper resin layers are dissolved out;

FIGS. 9A, 9B, 9C, 9D and 9E are first vertical cross-sectional views showing a method for producing the liquid discharge head of the first embodiment of the present invention, wherein FIG. 9A shows an element substrate; FIG. 9B shows a state where a lower resin layer is formed on the element substrate; FIG. 9C shows a state where an upper resin layer is formed on the element substrate; FIG. 9D shows a state where the upper resin layer formed on the element substrate is subjected to a pattern formation to obtain a slope on a lateral face; and FIG. 9E shows a state where the lower resin layer is subjected to a pattern formation;

FIGS. 10A, 10B, 10C, and 10D are second vertical cross-sectional views showing a method for producing the liquid discharge head of the first embodiment of the present invention, wherein FIG. 10A shows a state where a covering resin layer constituting an orifice substrate is formed; FIG. 10B shows a state where a discharge port portion is formed; FIG. 10C shows a state where a discharge port is formed; and FIG. 10D shows a state where internal upper and lower resin layers are dissolved out to complete a liquid discharge head;

FIGS. 17A and 17B are partially cut-off perspective view showing a combination structure of a heater and a nozzle in a fourth embodiment of the liquid discharge head of the present invention, wherein FIG. 17A shows a nozzle in a first nozzle array; and FIG. 17B shows a nozzle in a second nozzle array;

FIGS. 18A, 18B, 18C, 18D and 18E are first vertical cross-sectional views showing a method for producing the liquid discharge head of the fourth embodiment of the present invention, wherein FIG. 18A shows an element substrate; FIG. 18B shows a state where a lower resin layer is formed on the element substrate; FIG. 18C shows a state where an upper resin layer is formed on the element substrate; FIG. 18D shows a state where the upper resin layer formed on the element substrate is subjected to a pattern formation to obtain a slope on a lateral face; and FIG. 18E shows a state where the lower resin layer is subjected to a pattern formation; and FIGS. 19A, 19B, 19C, and 19D are second vertical cross-sectional views showing a method for producing the liquid discharge head of the fourth embodiment of the present invention, wherein FIG. 19A shows a state where a covering resin layer constituting an orifice substrate is formed; FIG. 19B shows a state where a discharge port portion is formed; FIG. 19C shows a state where a discharge port is formed; and FIG. 19D shows a state where internal upper and lower resin layers are dissolved out to complete a liquid discharge head.

DETAILED DESCRIPTION OF THE PREFERRED EMBODIMENTS

In the following, the liquid discharge head of the present invention for discharging droplets of a liquid such as ink will be explained by specific embodiments thereof, with reference to accompanying drawings.

At first there will be outlined a liquid discharge head embodying the present invention. The liquid discharge head of the present embodiment employs, among the ink jet recording methods, a method of utilizing means which generates thermal energy as the energy to be utilized for discharging liquid ink, and causing a state change in the ink by such thermal energy. This method allows to achieve a high density and a high definition in a character or an image to be recorded. In particular, the present embodiment employs a heat-generating resistance element for the thermal energy-generating means, and executes ink discharge, utilizing a pressure of a bubble generated when a film boiling is induced by heating the ink with such heat-generating resistance element.

(First Embodiment)

Figure 1:
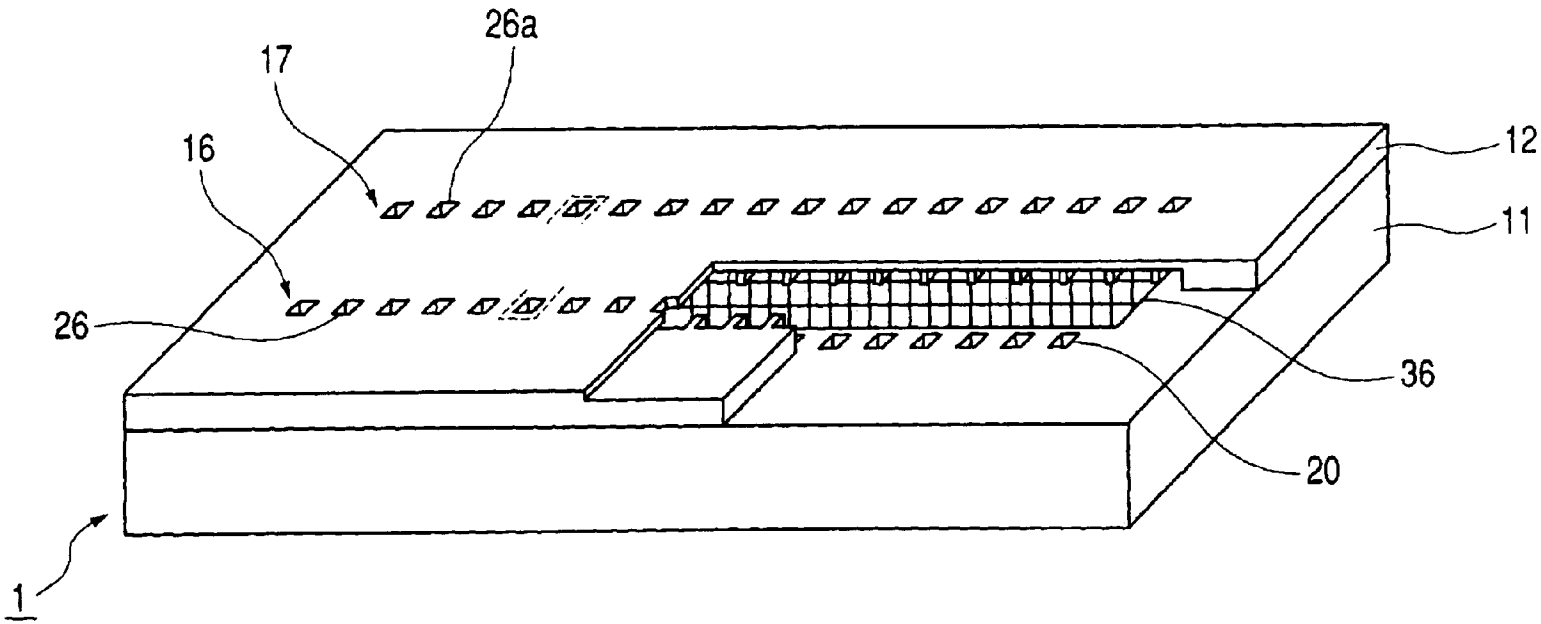
FIG. 1 is a schematic perspective view showing an entire configuration of a liquid discharge head of the present invention.

A liquid discharge head 1 of the first embodiment, though the details being explained later, has a configuration as shown in FIG. 1, in which partition walls for individually and independently forming a nozzle or an ink flow path are extended from a discharge port to the vicinity of a supply aperture, for each of plural heaters constituted of the heat-generating resistance elements. Such liquid discharge head has ink discharge means utilizing an ink jet recording method disclosed in Japanese Patent Application Laid-open Nos. 4-10940 and 4-10941, whereby a bubble generated at an ink discharge communicates with the external air through the discharge port.

The liquid discharge head 1 is provided with a first nozzle array 16 including plural heaters and plural nozzles, in which the longitudinal directions of the nozzles are arranged mutually parallel, and a second nozzle array 17 arranged in a position opposed to the first nozzle array across a supply chamber. In the first nozzle array 16 and the second nozzle array 17, neighboring nozzles are formed with a pitch of 600 dpi. Also the nozzles of the second nozzle array 17 are formed in positions displaced by ½ of the pitch, with respect to the nozzles of the first nozzle array 16.

In the following, there will be briefly explained a concept of optimizing the liquid discharge head 1, having the first nozzle array 16 and the second nozzle array 17 in which plural heaters and plural nozzles are arranged at a high density.

In general, among the physical parameters influencing the discharge characteristics of a liquid discharge head, an inertance (inertial force) and a resistance (resistance by viscosity) in the plural nozzles are major ones. An equation of motion for a non-compressive fluid moving a flow path of an arbitrary shape is given by following two equations:

$$\Delta \cdot v = 0 \text{ (equation of continuity)} \quad (1)$$

$$(\partial v/\partial t)+(v \cdot \Delta)v = -\Delta(P/\rho)+(\mu/\rho)\Delta^2 v+f \text{ (equation of Navier-Stokes)} \quad (2)$$

By approximating the equations (1) and (2) assuming that the convection term and the viscosity term are sufficiently small and the external force is absent, there is obtained:

$$\Delta^2 P = 0 \quad (3)$$

whereby the pressure is represented by a harmonic function.

Figure 2:
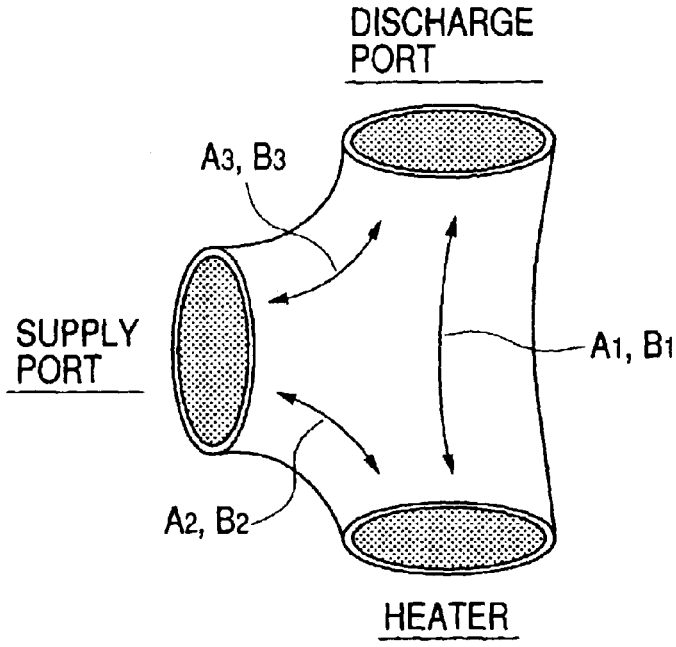
FIG. 2 is a schematic view showing a fluid flow in the liquid discharge head by a 3-aperture model.
Figure 3:
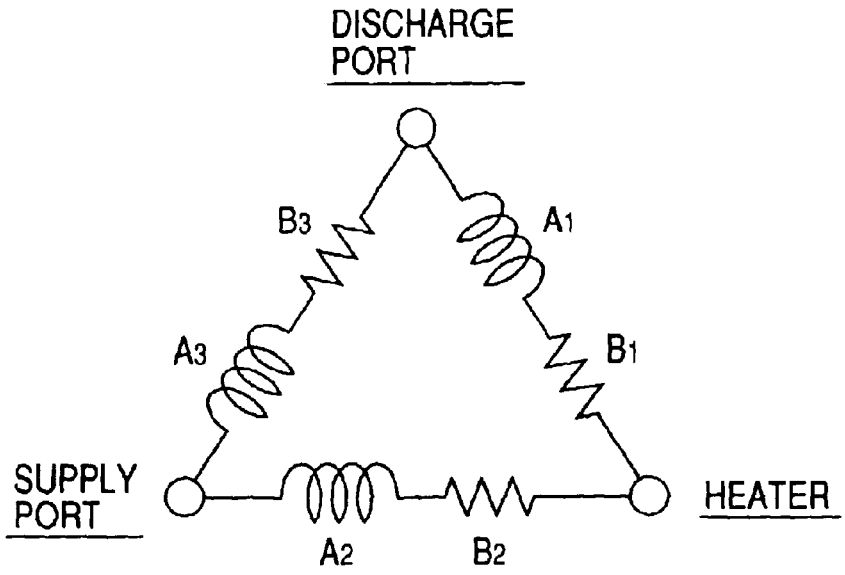
FIG. 3 is a schematic view showing an equivalent circuit of a liquid discharge head.

A liquid discharge head can be represented by a 3-aperture model as shown in FIG. 2 and an equivalent circuit as shown in FIG. 3.

An inertance is defined as a "difficulty of motion" when a still fluid suddenly starts to move. It is similar electrically to an inductance L which hinders a change in a current. In a mechanical spring-mass model, it corresponds to a weight (mass).

In a mathematical representation, the inertance is given by a ratio to a secondary differential by time of a fluid volume V, or a differential by time of a flow amount F (=ΔV/Δt):

$$(\Delta^2 V/\Delta t^2)=(\Delta F/\Delta t)=(1/A)\times P \quad (4)$$

wherein A stands for the inertance.

For example, assuming a pipe-shaped tubular flow path with a density ρ, a length L and a cross sectional area $S_0$, the inertance $A_0$ of such one-dimensional model flow path is given by:

$$A_0=\rho\times L/S_0$$

and is thus proportional to the length of the flow path and inversely proportional to the cross section.

It is possible, based on an equivalent circuit as shown in FIG. 3, to schematically predict and analyze the discharge characteristics of a liquid discharge head.

In the liquid discharge head of the present invention, a discharge phenomenon is considered as a phenomenon of transferring from an inertial flow to a viscous flow. An initial flow prevails particularly in an initial stage of bubble generation by the heater in the bubble generating chamber, but a viscous flow prevails in a later stage of the discharge (namely within a period from the start of a movement of a meniscus, formed at the discharge port, toward the ink flow path to the return of the meniscus by the filling of the ink up to an aperture end of the discharge port by a capillary phenomenon). In these operations, based on the foregoing equations, the inertance shows, in the initial stage of the bubble generation, a large contribution to the discharge characteristics, particularly to the discharge volume and the discharge speed, while the resistance (resistance by viscosity) shows, in the later stage of the discharge, a large contribution to the discharge characteristics, particularly a time required for ink refilling (hereinafter called refill time).

The resistance (resistance by viscosity) can be represented by the foregoing equation (1) and a stationary Stokes flow defined by:

$$\Delta P=\eta\Delta^2\mu \quad (5)$$

whereby a viscosity resistance B can be determined. Also the later stage of discharge can be approximated by a 2-aperture model (one-dimensional flow model), since a meniscus is generated in the vicinity of the discharge port to cause an ink flow by a suction force principally based on a capillary force.

Thus, it can be determined from a Poiseuille equation (6) describing a viscous fluid:

$$(\Delta V/\Delta t)=(1/G)\times(1/\eta)\{(\Delta P/\Delta x)\times S(x)\} \quad (6)$$

wherein G is a shape factor. Also the viscosity resistance B, being generated in a fluid flowing according to an arbitrary pressure difference, can be determined from:

$$B=\int_0^L\{(G\times\eta)/S(x)\}\Delta x \quad (7)$$

Assuming a pipe-shaped tubular flow path with a density ρ, a length L and a cross sectional area $S_0$, the resistance (viscosity resistance) is given, according to the foregoing equation (7), by:

$$B=8\eta\times L/(\pi\times S_0^2) \quad (8)$$

and is thus approximately proportional to the length of the nozzle and inversely proportional to a square of the cross section of the nozzle.

Therefore, in order to improve the discharge characteristics of the liquid discharge head, particularly all of the discharge speed, the discharge volume of the ink droplet and the refill time, it is necessary and sufficient, in consideration of the inertance equation, to increase as far as possible the inertance from the heater to the discharge port in comparison with the inertance from the heater to the supply aperture, and to decrease the resistance in the nozzle.

The liquid discharge head of the present invention is capable of satisfying both of the aforementioned standpoint and a target of arranging the plural heaters and plural nozzles at a high density.

In the following, a specific configuration of the liquid discharge head embodying the present invention will be explained with reference to accompanying drawings.

As shown in FIGS. 4 to 7, the liquid discharge head is provided with an element substrate 11 on which plural heaters 20, constituting heat generating resistance elements or discharge energy generating elements, are provided, and an orifice substrate 12 which is laminated and adjoined to a principal plane of the element substrate 11 to form plural ink flow paths.

The element substrate 11 is formed for example by glass, ceramics, resin or metal, and is usually composed of silicon.

On the principal plane of the element substrate 11, there are formed, for each ink flow path, a heater 20, electrodes (not shown) for applying a voltage to the heater 20, and wirings (not shown) connected to the electrodes, by a predetermined wiring pattern.

Also on the principal plane of the element substrate 11, an insulation film 21 for accelerating dissipation of accumulated heat is provided so as to cover the heaters 20 (cf. FIG. 8). Also on the principal plane of the element substrate 11, a protective film 22, for protecting the principal plane from a cavitation generated at the extinction of a bubble, is provided so as to cover the insulation film 21 (cf. FIG. 8).

Figure 4:
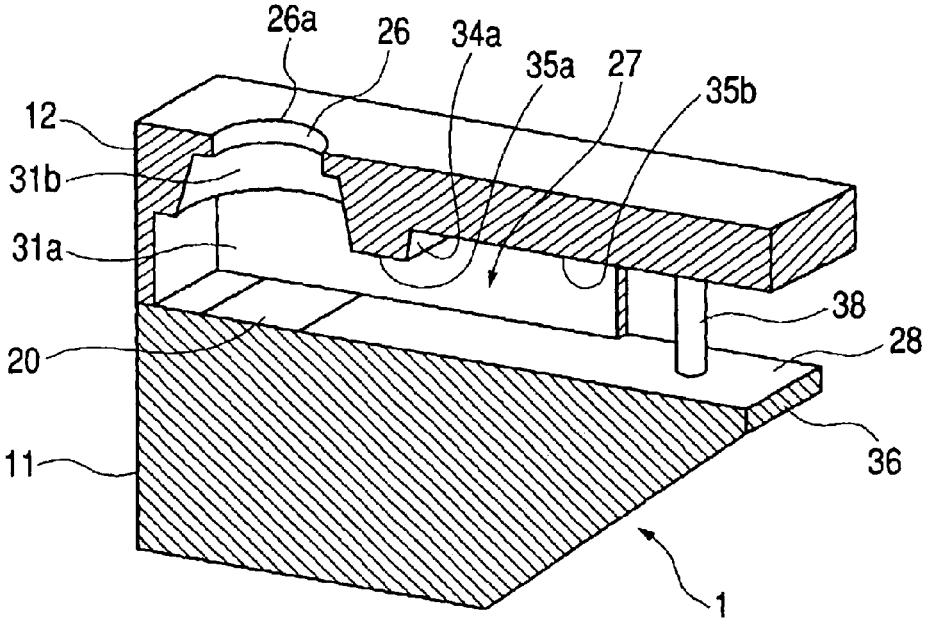
FIG. 4 is a partially cut-off perspective view showing a combination structure of a heater and a nozzle in a first embodiment of the liquid discharge head of the present invention.
Figure 5:
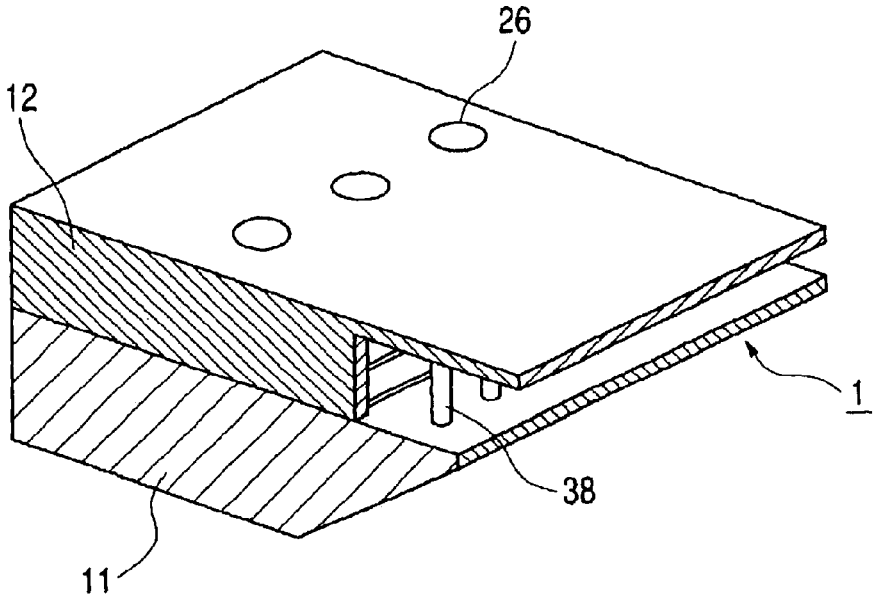
FIG. 5 is a partially cut-off perspective view showing a combination structure of plural heaters and plural nozzles in a first embodiment of the liquid discharge head of the present invention.
Figure 6:
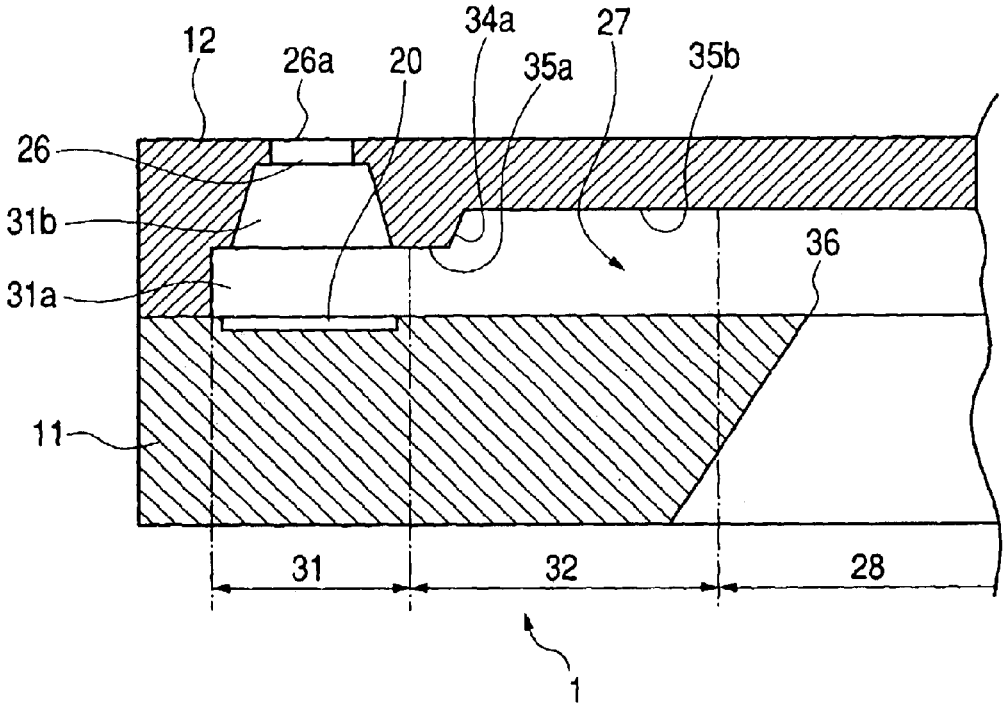
FIG. 6 is a lateral cross-sectional view showing a combination structure of a heater and a nozzle in a first embodiment of the liquid discharge head of the present invention.

The orifice substrate 12 is formed with a thickness of about 30 μm with a resinous material. As shown in FIGS. 4 and 5, the orifice substrate 12 is provided with plural discharge port portions 26 for discharging an ink droplet, and also with plural nozzles 27 in which the ink flows and a supply chamber 28 for supplying such nozzles 27 with the ink.

The nozzle 27 includes a discharge port portion 26 having a discharge port 26*a* for discharging a liquid droplet, a bubble generating chamber 31 for generating a bubble in the liquid contained therein by the heater 20 constituting the discharge energy generating element, and a supply path 32 for supplying the bubble generating chamber 31 with the liquid.

The bubble generating chamber 31 is constituted of a first bubble generating chamber 31*a* of which a bottom surface is constituted by the principal plane of the element substrate 11 and which communicates with the supply path 32 and serves to generate a bubble in the liquid contained therein by the heater 20, and a second bubble generating chamber 31*b* which is provided in communication with an upper aperture of the first bubble generating chamber 31*a* parallel to the principal plane of the element substrate 11 and in which the bubble generated in the first bubble generating chamber 31*a* grows. The discharge port portion 26 is provided in communication with an upper aperture of the second bubble generating chamber 31*b*, and a step difference is formed between a lateral wall surface of the discharge port portion 26 and a lateral wall surface of the second bubble generating chamber 31*b*.

The discharge port 26*a* of the discharge port portion 26 is formed in a position opposed to the heater 20 formed on the element substrate 11, and is formed, in the present case, in a circular hole of a diameter for example of about 15 μm. Also, the discharge port 26 may be formed in a substantially star-like shape with radially pointed ends, according to the required discharge characteristics.

The second bubble generating chamber 31*b* has a truncated conical shape, with a lateral wall constricted toward the discharge port with an inclination of 10° to 45° with respect to a plane perpendicular to the principal plane of the element substrate, and communicates at an upper plane with the aperture of the discharge port portion 26, with a step difference thereto.

The first bubble generating chamber 31*a* is present on an extension of the supply path 32, and is formed with an approximately rectangular bottom surface opposed to the discharge port portion 26.

The nozzle 27 is so formed that a shortest distance HO between a principal plane of the heater 20, parallel to the principal plane of the element substrate 11, and the discharge port 26*a* is 30 μm or less.

In the nozzle 27, an upper plane of the first bubble generating chamber 31*a*, parallel to the principal plane, and a first upper plane 35*a* parallel to the principal plane of the supply path 32 adjacent to the bubble generating chamber 31 are formed by a continuous same plane, which is connected, by a first step difference 34*a* inclined to the principal plane, to a second upper plane 35*b* positioned higher and parallel to the principal plane of the element substrate 11 and provided at a side of the supply path 32 toward the supply chamber 28.

The first upper plane 35*a* from the first step difference 35*a* to the aperture at the bottom plane of the second bubble generating chamber 31*b* constitutes a control portion, which controls the ink flowing by the bubble in the bubble generating chamber 31. A maximum height from the principal plane of the element substrate 11 to the upper plane of the supply path 32 is made smaller than a height from the principal plane of the element substrate 11 to the upper plane of the second bubble generating chamber 31*b*.

The supply path 32 communicates with the bubble generating chamber 31 at an end and with the supply chamber 28 at the other end.

In the nozzle 27, as explained in the foregoing, because of the presence of the control portion, the first upper plane 35*a*, constituting a portion from an end of the supply path adjacent to the first bubble generating chamber 31*a* to the first bubble generating chamber 31*a*, is formed with a smaller height to the principal plane of the element substrate 11 than a height of the second upper plane 35 of the supply path 32 connected at the side of the supply chamber 28. Consequently in the nozzle 27, because of the presence of the first upper plane 35*a*, the cross section of the ink flow path is made smaller in a portion from an end of the supply path 32 adjacent to the first bubble generating chamber 31*a* to the first bubble generating chamber 31*a* than in other portions of the flow path.

Figure 7:
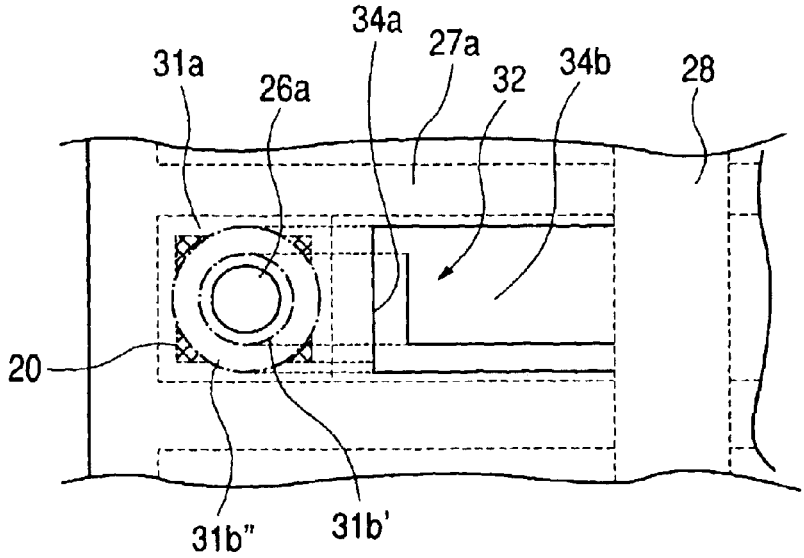
FIG. 7 is a horizontal cross-sectional view showing a combination structure of a heater and a nozzle in a first embodiment of the liquid discharge head of the present invention.

Also as shown in FIGS. 4 and 7, the nozzle 27 is formed in a straight shape having an almost constant width, perpendicular to the ink flowing direction parallel to the principal plane of the element substrate 11, over a range from the supply chamber 28 to the bubble generating chamber 31. Furthermore, in the nozzle 27, each of internal wall planes opposed to the principal plane of the element substrate 11 is formed parallel thereto over a range from the supply chamber 28 to the bubble generating chamber 31.

In the present case, the nozzle 27 is so formed that the first upper plane 35*a* has a height for example of about 14 μm from the principal plane of the element substrate 11, and that the second upper plane 35*b* has a height for example of about 20 μm from the principal plane of the element substrate 11. The nozzle 27 is also so formed that the first upper plane 35*a* has a length for example of about 10 μm along the ink flowing direction.

The element substrate 11 is also provided, on a rear surface opposite to the principal plane which is adjacent to the orifice substrate, with a supply aperture 36 for ink supply to the supply chamber 28 from the side of such rear surface.

Also as shown in FIGS. 4 and 5, in the supply chamber 28, a cylindrical nozzle filter 38 for removing dusts in the ink by filtration is provided for each nozzle 27 and in a position adjacent to the supply aperture 38, in such a manner as to bridge the element substrate 11 and the orifice substrate 12. The nozzle filter 38 is provided for example at a position of about 20 μm from the supply aperture. Also in the supply chamber 28, the nozzle filters 38 are with a mutual gap of about 10 μm. Such nozzle filters 38 prevent dust clogging in the supply path 32 and the discharge port 26, thereby ensuring satisfactory discharging operation.

In the following there will be explained an operation of discharging an ink droplet from the discharge port 26, in the liquid discharge head 1 of the above-described configuration.

At first, in the liquid discharge head 1, the ink supplied from the supply aperture 36 to the supply chamber 28 is supplied to the nozzles 17 of the first nozzle array 16 and the second nozzle array 17. The ink supplied into each nozzle 27 flows along the supply path 32 and fills the bubble generating chamber 31. The ink filled in the bubble generating chamber 31 is made, by a growing pressure of a bubble generated by a film boiling induced by the heater 20, to fly in a direction substantially perpendicular to the principal plane of the element substrate 11, and is discharged as an ink droplet from the discharge port 26*a* of the discharge port portion 26.

Since the second bubble generating chamber 31*b* is formed as a truncated cone with a lateral wall constricted toward the discharge port by an inclination of 10° to 45° with respect to a plane perpendicular to the principal plane of the element substrate and communicates at the upper plane with the aperture of the discharge port portion 26 across a step difference, when the ink in the first bubble generating chamber 31*a* is discharged through the second bubble generating chamber 31*b* by the pressure of the growing bubble generated by the film boiling induced by the heater 20, the ink flow is rectified in a direction from the element substrate 11 toward the discharge port 26*a* with a gradual decrease in the ink volume, and, in the vicinity of the discharge port 26*a*, the liquid droplet flies in a direction perpendicular to substrate.

At the discharge of the ink filled in the bubble generating chamber 31, a part of the ink therein flows toward the supply path 32 by the pressure of the bubble generated in the bubble generating chamber 31. In the liquid discharge head 1, when a part of the ink in the bubble generating chamber 31 flows toward the supply chamber 32, the control portion having the first upper plane 35*a* and constricting the flow path 32 functions as a fluid resistance to the ink flowing from the bubble generating chamber 31 to the supply chamber 28 through the supply path 32. Consequently, in the liquid discharge head 1, the control portion suppresses the flow of the ink from the bubble generating chamber 31 toward the supply path 32, thereby preventing a decrease of the ink in the bubble generating chamber 31 to satisfactorily secure the ink discharge volume, and suppressing a fluctuation in the volume of the liquid droplet discharged from the discharge port to secure an appropriate discharge volume.

In such liquid discharge head 1, an energy distribution ratio η toward the discharge port 26 can be given by:

$$\eta=(A_1/A_0)=\{A_2/(A_1+A_2)\} \quad (9)$$

wherein $A_1$ is an inertance from the heater 20 to the discharge port 26, $A_2$ is an inertance from the heater 20 to the supply aperture 36, and $A_0$ is an internal of the entire nozzle 27. Each inertance can be determined by solving a Laplacian equation for example with a three-dimensional finite element method solver.

According to the foregoing equation, the liquid discharge head 1 has an energy distribution ratio η of 0.59 toward the discharge port 26. In the liquid discharge head 1, it is possible to maintain the discharge speed and the discharge volume comparable to those in a prior liquid discharge head, by maintaining the energy distribution ratio η approximately same as that in the prior liquid discharge head. Also it is preferred that the energy distribution ratio η satisfies a relation $0.5<\eta<0.8$. In the liquid discharge head 1, an energy distribution ratio η equal to or less than 0.5 cannot secure the discharge speed and the discharge volume at a satisfactory level, while an energy distribution ratio η equal to or larger than 0.8 cannot achieve satisfactory ink flow, so that the refilling cannot be achieved.

The liquid discharge head 1, in case of employing for example a dye-based black ink (surface tension: $47.8\times10^{-3}$ N/m, viscosity: 1.8 cp, pH: 9.8), can reduce the viscosity resistance B in the nozzle 27 by about 40% in comparison with a prior liquid discharge head. The viscosity resistance B can be determined, for example, with a three-dimensional finite element method solver and can be easily calculated by determining a length and a cross section of the nozzle 27.

Consequently the liquid discharge head 1 of the present embodiment can increase the discharge speed by about 40% in comparison with a prior liquid discharge head, thereby realizing a discharge frequency response of about 25 to 30 kHz.

Also the strength of the orifice substrate 12 is improved since the maximum height from the principal plane of the element substrate 11 to the upper plane of the supply path 32 is made smaller.

In the following there will be explained a method for producing the liquid discharge head 1 of the above-described configuration, with reference to FIGS. 8A to 10D.

The liquid discharge head 1 is produced through a first step of forming the element substrate 11, a second step of forming, on the element substrate 11, an upper resin layer 41 and a lower resin layer 42 for constituting an ink flow path, a third step of forming a desired nozzle pattern in the upper resin layer 41, a fourth step of forming a slope on a lateral surface of the resin layer, and a fifth step of forming a desired nozzle pattern in the lower resin layer 42.

Then, in this producing method, the liquid discharge head 1 is produced through a sixth step of forming a covering resin layer 43 for constituting the orifice substrate 12, on the upper resin layer 41 and the lower resin layer 42, a seventh step of forming a discharge port portion 26 in the covering resin layer 43, an eighth step of forming a supply aperture 36 in the element substrate 11, and a ninth step of dissolving out the lower resin layer 42 and the upper resin layer 41.

Figure 8A:
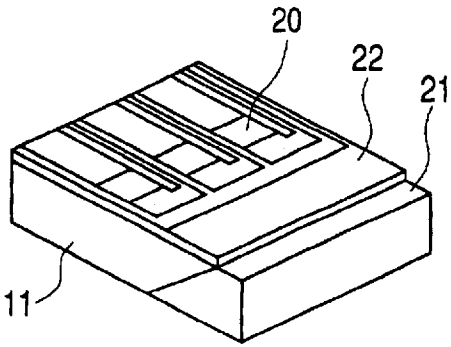
Figure 9A:
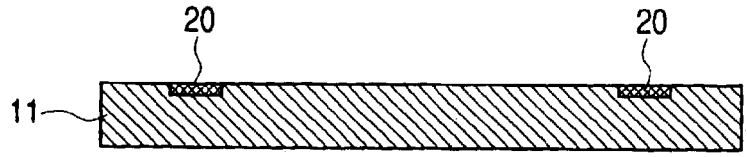

The first step is, as shown in FIGS. 8A and 9A, a substrate forming step by forming plural heaters 20 and predetermined wirings for voltage application to such heaters 20 for example by a patterning process on a principal plane of a Si chip, forming an insulation film 21 so as to cover the heaters 20 in order to facilitate dissipation of the accumulated heat, and further forming a protective film 22 for protecting the principal plane from a cavitation generated at the extinction of the bubble, thereby forming the element substrate 11.

Figure 8B:
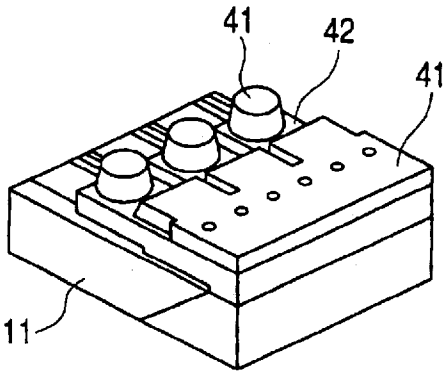
Figure 9B:
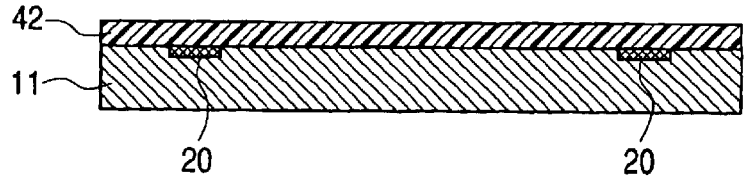
Figure 9C:
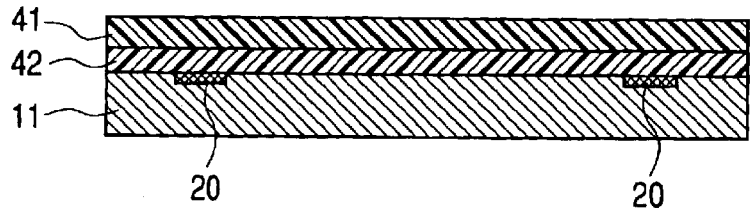
Figure 11:
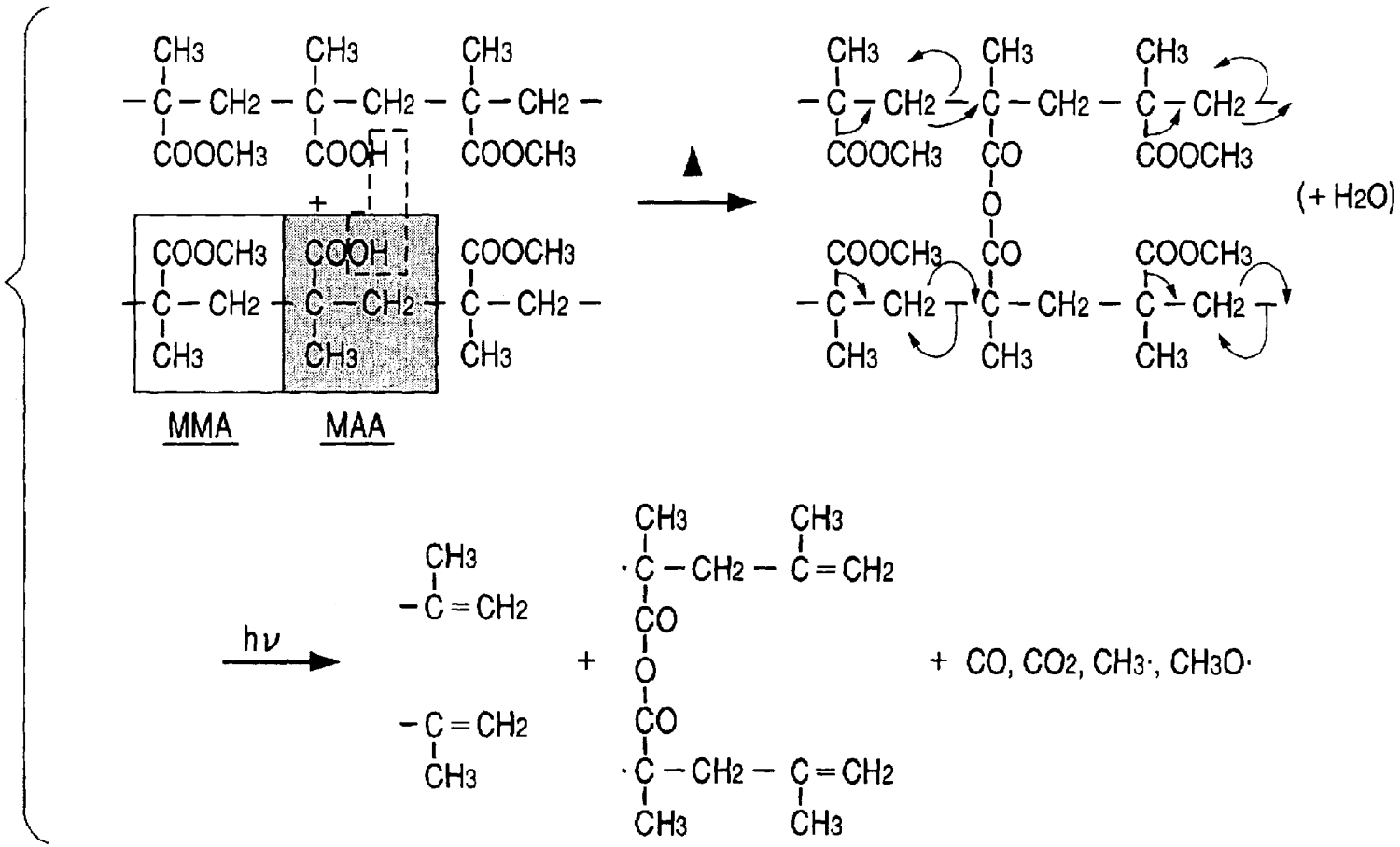
FIG. 11 is a chemical reaction formula showing chemical changes in the upper resin layer and the lower resin layer by electron beam irradiation.

The second step is, as shown in FIGS. 8B, 9B and 9C, a coating step for coating, by spin coating method on the element substrate 11, in succession a lower resin layer 42 and an upper resin layer 41 which undergo a destruction of chemical bonds in the molecule and become soluble under an irradiation with a deep-UV light (hereinafter represented as DUV light) of a wavelength not exceeding 300 nm. In this coating step, a resinous material of thermally crosslinkable type by a dehydration condensation reaction is employed as the lower resin layer 42, whereby mutual dissolution of the lower resin layer 42 and the upper resin layer 41 can be prevented at the spin coating of the upper resin layer 41. As an example of the lower resin layer 42, there was employed a two-component copolymer obtained by a radical polymerization of methyl methacrylate (MMA) and methacrylic acid (MAA) (P(MMA-MAA)=90:10) and dissolved in cyclohexanone as a solvent. Also as an example of the upper resin layer 41, there was employed polymethyl isopropenyl ketone (PMIPK) dissolved in cyclohexanone as a solvent. FIG. 11 shows a chemical reaction formula of forming a thermally crosslinked film, by a dehydration condensation reaction of the two-component copolymer (P(MMA-MAA)) employed as the lower resin layer 42. This dehydration condensation reaction can form a firm crosslinked film by heating for 30 minutes to 2 hours at 180° C. to 200° C. The crosslinked film is insoluble in a solvent, but undergoes a decomposition reaction as shown in FIG. 11 to a smaller molecular weight under an irradiation with an electron beam or a DUV light, and becomes soluble in a solvent only in thus irradiated area.

Figure 9D:
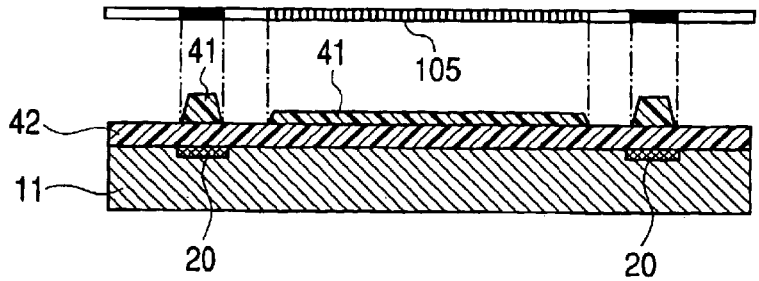

The third step is, as shown in FIGS. 8B and 9D, a pattern forming step of exposing the upper resin layer 41 to a near UV light (hereinafter represented as NUV light) of a wavelength region of about 260 to 330 nm, employing a DUV light irradiating exposure apparatus and mounting thereon a filter capable of intercepting the DUV light with a wavelength under 260 nm as wavelength selecting means thereby passing the light of a wavelength of 260 nm or higher, and then developing the resin layer thereby forming a desired nozzle pattern in the upper resin layer 41. As a filter for intercepting the DUV light of a wavelength less than 260 nm, there can be employed a slit mask 105 having different slit pitches to arbitrarily set the height of the nozzle pattern, whereby the nozzle patterns of the second bubble generating chamber 31*b* and the second upper plane 35*b* can be formed with respectively different heights.

Figure 12:
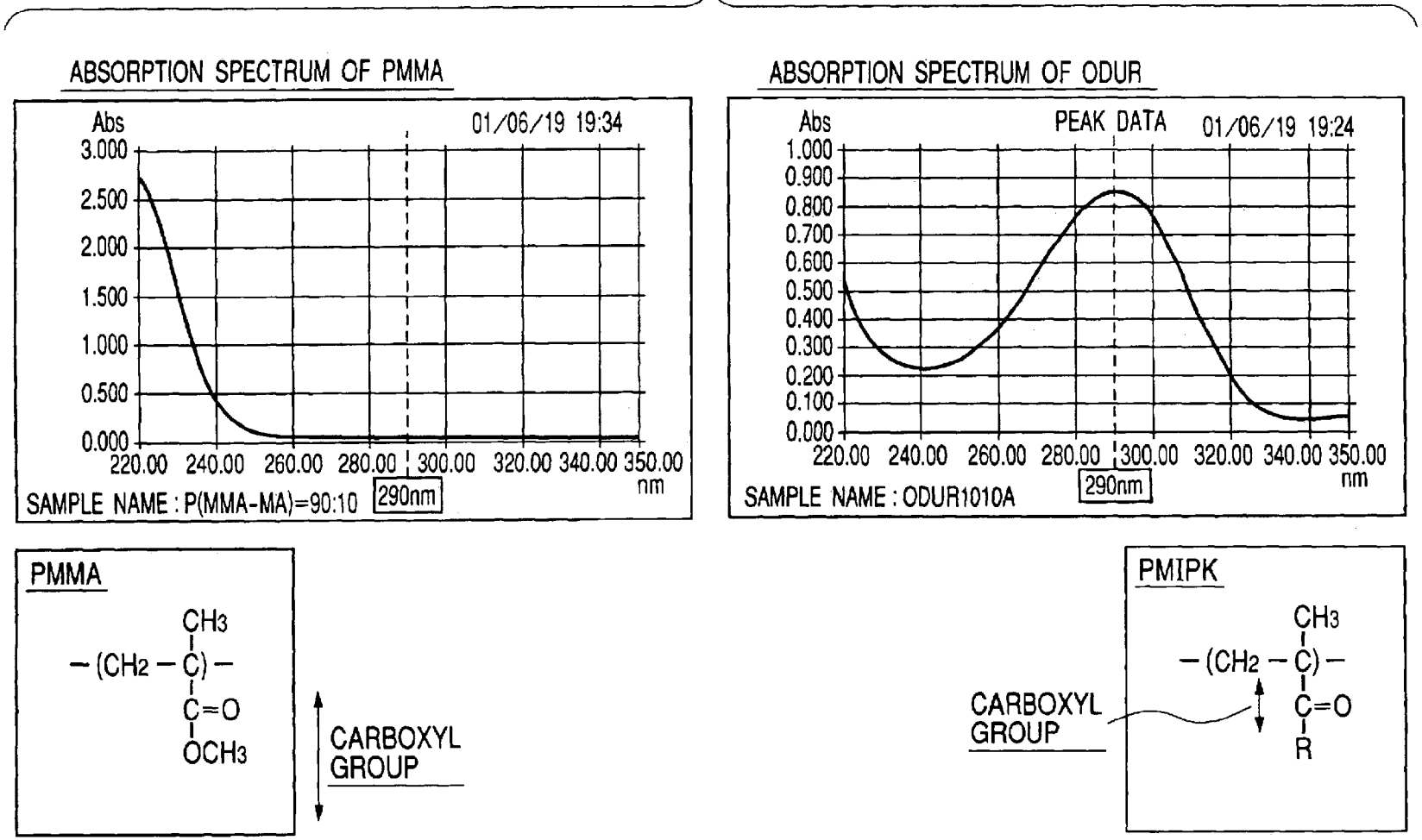
FIG. 12 is a chart showing absorption spectra of materials of the lower resin layer and the upper resin layer in a region of 210 to 330 nm.

At the formation of the nozzle pattern in the upper resin layer in this third step, since the upper resin layer 41 and the lower resin layer 42 have a sensitivity ratio of 40:1 or higher to the NUV light of a wavelength region of 260 to, 330 nm, the lower resin layer 42 is not affected by the exposure and P(MMA-MAA) therein is not decomposed. Also the lower resin layer 42, being thermally crosslinked, is not dissolved in the developing solution for the upper resin layer 41. FIG. 12 shows absorption spectra of the materials of the lower resin layer 42 and the upper resin layer 41 in a wavelength region of 210 to 330 nm.

The fourth step executes, as shown in FIGS. 8B and 9D, a heating for 5 to 20 minutes at 140° C. on the upper resin layer 41 subjected to the pattern formation, thereby forming an inclination of an angle of 10° to 45° on a lateral face of the upper resin layer. The inclination angle is correlated with a volume (shape and film thickness) of the above-mentioned pattern and a temperature and a time of the heating, and can be controlled at a designated value within the aforementioned angular range.

Figure 9E:
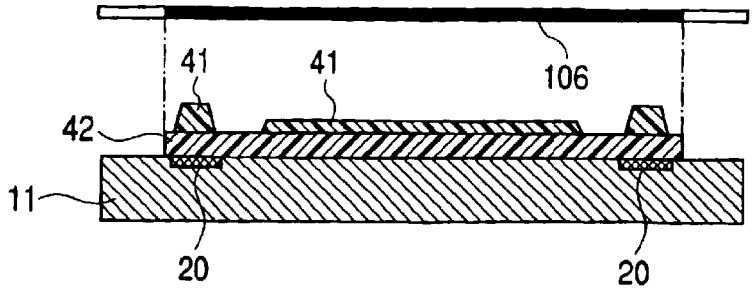

The fifth step is, as shown in FIGS. 8B and 9E, a pattern forming step of exposing and developing the lower resin layer 42 under an irradiation of a DUV light of a wavelength region of 210 to 330 nm by the aforementioned exposure apparatus with a mask 106, thereby forming a desired nozzle pattern in the lower resin layer 42. The P(MMA-MAA) material employed in the lower resin layer 42 has a high resolution and can provide a trench structure with a side wall inclination angle of 0° to 5° even at a thickness of about 5 to 20 μm.

Also, if necessary, it is possible to form an additional inclination on the lateral wall of the lower resin layer 42, by heating the lower resin layer 42 after patterning at a temperature of 120° C. to 140° C.

Figure 10A:
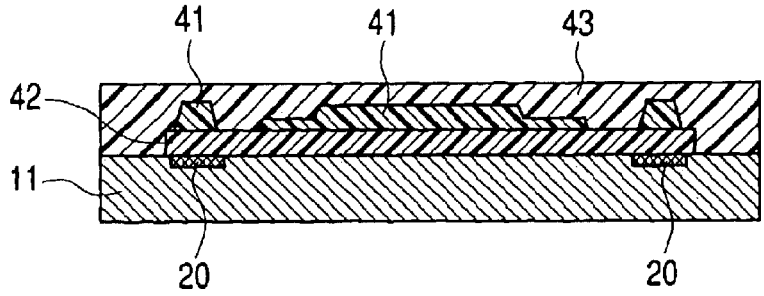

The sixth step is, as shown in FIG. 10A, a coating step of coating a transparent covering resin layer 43 for constituting the orifice substrate 12, on the upper resin layer 41 and the lower resin layer 42 in which the nozzle patterns are formed and which are rendered soluble by the destruction of the crosslinking bonds in the molecule by the DUV irradiation.

Figure 8C:
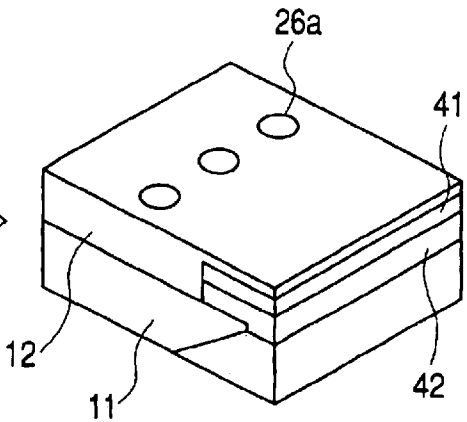
Figure 10B:
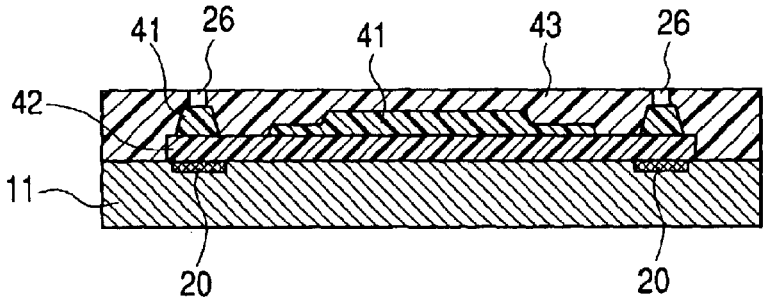

The seventh step executes, as shown in FIGS. 8C and 10B, an UV light irradiation on the covering resin layer 43 by an exposure apparatus, and eliminates a portion corresponding to the discharge port portion 26 by an exposure and a development, thereby forming the orifice substrate 12. A lateral wall of the discharge port portion 26 formed in such orifice substrate 12 is preferably formed with an inclination angle of about 0° with respect to a plane perpendicular to the principal plane of the element substrate. However an inclination angle of about 0° to 10° does not cause a major difficulty in the discharge characteristics for the liquid droplet.

Figure 8D:
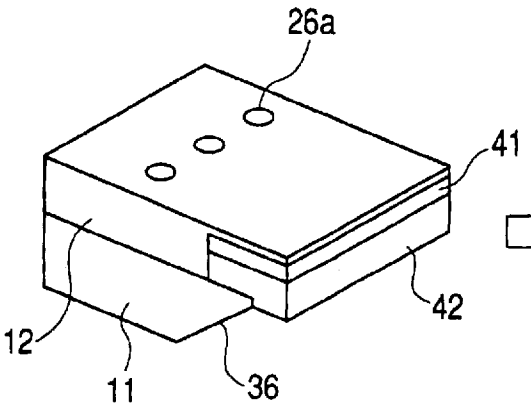
Figure 10C:
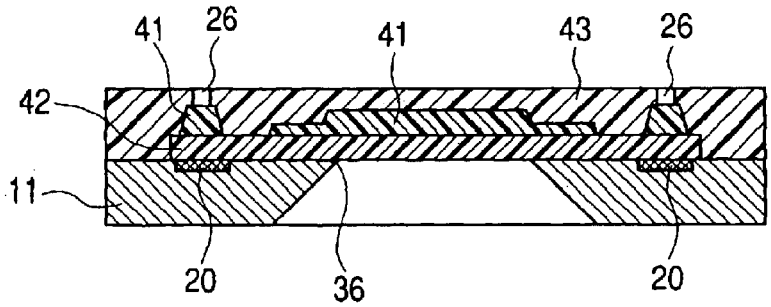

The eighth step executes, as shown in FIGS. 8D and 10C, a chemical etching or the like on the rear surface of the element substrate 11, thereby forming the supply aperture 36 in the element substrate 11. For the chemical etching, there can be employed, for example, an anisotropic etching employing a strongly alkaline solution (KOH, NaOH or TMAH).

Figure 8E:
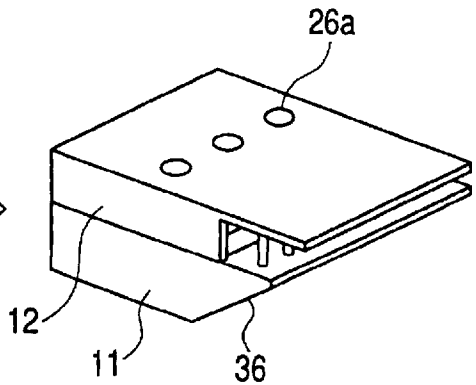
Figure 10D:
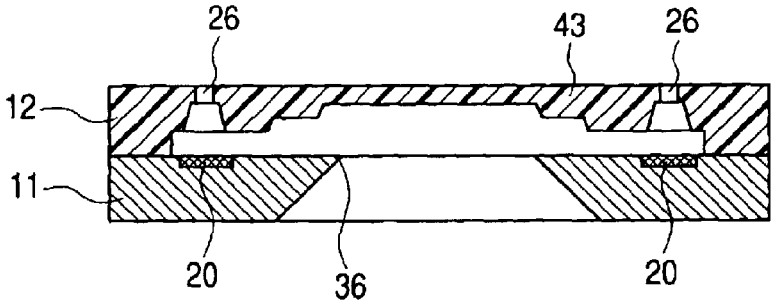

The ninth step executes, as shown in FIGS. 8E and 10D, an irradiation of a DUV light of a wavelength of about 330 nm or shorter from the principal plane side of the element substrate 11 through the covering resin layer 43 thereby dissolving out the upper resin layer 41 and the lower resin layer 42, positioned between the element substrate 11 and the orifice substrate 12 and constituting a nozzle mold, through the supply aperture 36.

In this manner, there is obtained a chip provided with the nozzle 27 which includes the discharge port 26*a*, the supply aperture 36 and the control portion 33 formed as a step difference in the supply path 32 connecting these components. A liquid discharge head can be obtained by electrically connecting such chip with a wiring board (not shown) for driving the heater 20.

In the foregoing method, the slit mask of different slit pitches is employed as filters to arbitrarily set the height of the nozzle pattern within a step, but, in the aforementioned producing method for the liquid discharge head 1, it is possible to form a control portion with step differences of three or more steps by forming, in the direction of thickness of the element substrate 11, more laminar structures in the upper resin layer 41 and the lower resin layer 42 which are rendered soluble by the destruction of the crosslinking bonds in the molecule under the irradiation of the DUV light. For example a multi-stepped nozzle structure can be formed by employing a resinous material sensitive to the light of a wavelength of 400 nm or longer on the upper resin layer.

The producing method for the liquid discharge head 1 of the present embodiment is preferably executed basically according to a producing method for a liquid discharge head utilizing, as the ink discharge means, an ink jet recording method disclosed in Japanese Patent Application Laid-open Nos. 4-10940 and 4-10941. These references disclose an ink droplet discharging method in a configuration in which a bubble generated by a heater is made to communicate with the external air, and provide a liquid discharge head capable of discharging an ink droplet of an extremely small amount equal to or less than 50 pl.

In such liquid discharge head 1, since the bubble communicates with the external air, the volume of the ink droplet discharged from the discharge port 26*a* is significantly dependent on the volume of the ink present between the heater 20 and the discharge port 26, namely the ink volume filled in the bubble generating chamber 31. Stated differently, the volume of the discharged ink droplet is substantially determined by a structure of the bubble generating chamber 31 in the nozzle 27 of the liquid discharge head 1.

Consequently, the liquid discharge head 1 can provide an image of a high quality without an unevenness of the ink. The liquid discharge head of the present invention exhibits a largest effect when applied to a liquid discharge head in which the shortest distance between the heater and the discharge port is selected as 30 μm or smaller in order to cause the bubble to communicate with the external air, but can effectively be applied to any liquid discharge head in which the ink droplet is made to fly in a direction perpendicular to the principal plane of the element substrate bearing the heater.

In the liquid discharge head 1, as explained in the foregoing, the presence of the second bubble generating chamber 31*b* of a truncated conical shape achieves a flow rectification in a direction from the element substrate 11 toward the discharge port 26*a* with a gradual decrease of the ink volume, whereby the liquid droplet flies in a direction perpendicular to the element substrate 11 in the vicinity of the discharge port 26*a*. Also the presence of the first upper plane 35*a* for controlling the ink flow in the bubble generating chamber 31 stabilizes the volume of the discharged ink droplet, and the upper plane of the supply path, made higher toward the supply chamber, allows to increase the liquid amount in the supply path, thereby suppressing a temperature increase in the discharged liquid by heat conduction from the liquid of thus lower temperature, whereby the dependence of the discharge amount on the temperature can be improved and the discharge efficiency of the ink droplet can be improved.

(Second Embodiment)

In the first embodiment, the second bubble generating chamber 31*b* of a truncated conical shape is formed on the first bubble generating chamber 31*a* and has a lateral wall constricted toward the discharge port 26*a* with an inclination angle of 10° to 45° with respect to a plane perpendicular to the principal plane of the element substrate 11, but the second embodiment provides a liquid discharge head 2 of a configuration in which the ink filled in the bubble generating chamber can flow more easily toward the discharge port. In the liquid discharge head 2, components equivalent to those in the foregoing liquid discharge head 1 are represented by same numbers and will not be explained further.

In the liquid discharge head 2 of the second embodiment, as in the first embodiment, a bubble generating chamber 56 includes a first bubble generating chamber 56*a* in which a bubble is generated by the heater 20, and a second bubble generating chamber 56*b* positioned between the first bubble generating chamber 56*a* and a discharge port portion 53, and the lateral wall of the second bubble generating chamber 56*b* is constricted toward the discharge port portion 53 with an inclination of 10° to 45° with respect to a plane perpendicular to the principal plane of the element substrate 11.

In addition, in the first bubble generating chamber 56*a*, wall surfaces provided for individually separating the plural first bubble generating chambers 56*a* arranged in an array are so inclined as to form a constriction toward the discharge port with an inclination angle of 0° to 10° with respect to a plane perpendicular to the principal plane of the element substrate 11, and such wall surfaces are so inclined, in the discharge port portion 53, as to form a constriction toward the discharge port 53*a* with an inclination angle of 0° to 5° with respect to a plane perpendicular to the principal plane of the element substrate 11.

Figure 13:
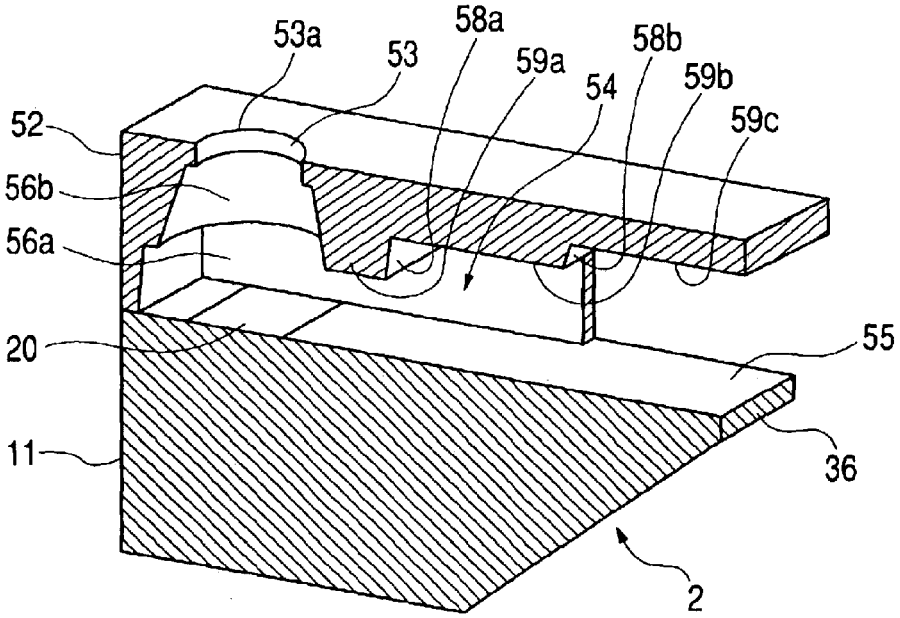
FIG. 13 is a partially cut-off perspective view showing a combination structure of a heater and a nozzle in a second embodiment of the liquid discharge head of the present invention.
Figure 14:
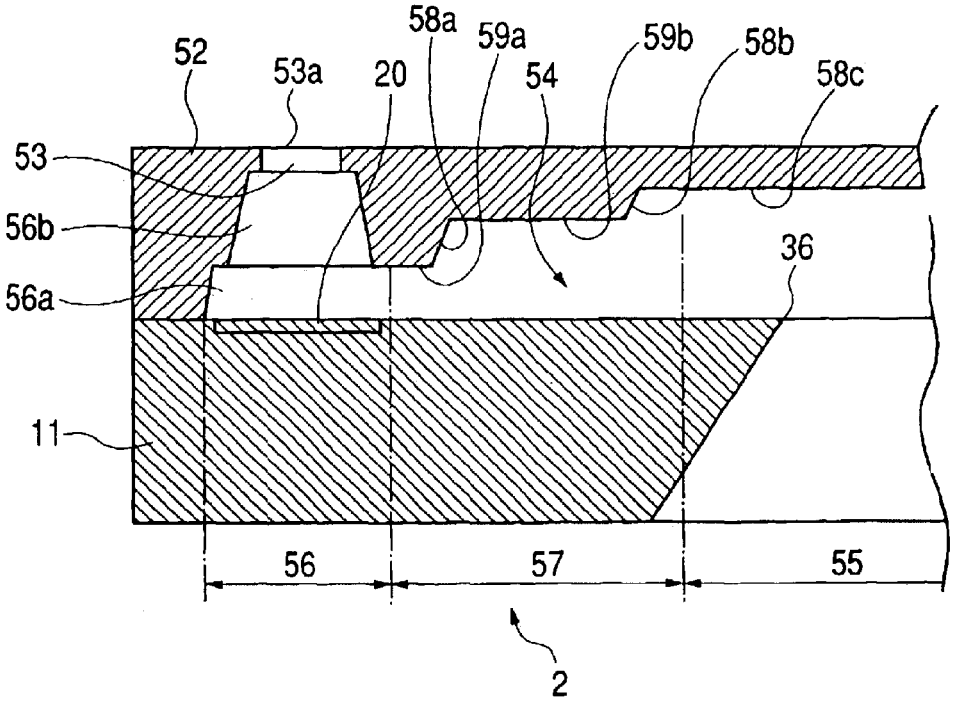
FIG. 14 is a lateral cross-sectional view showing a combination structure of a heater and a nozzle in a second embodiment of the liquid discharge head of the present invention.

As shown in FIGS. 13 and 14, an orifice substrate 52 provided with a liquid discharge head 2 is formed with a thickness of about 30 μm by a resinous material. As already explained in relation to FIG. 1, the orifice substrate 52 is provided with plural discharge ports 53*a* for discharging an ink droplet, also with plural nozzles 54 in which the ink flows and a supply chamber 55 for supplying each of such nozzles 54 with the ink.

The discharge port 53*a* is formed in a position opposed to the heater 20 formed on the element substrate 11, and is formed in a circular hole of a diameter for example of about 15 μm. Also, the discharge port 53 may be formed in a substantially star-like shape with radially pointed ends, according to the required discharge characteristics.

The nozzle 54 includes a discharge port portion 53 having a discharge port 53*a* for discharging a liquid droplet, a bubble generating chamber 56 for generating a bubble in the liquid contained therein by the heater 20 constituting the discharge energy generating element, and a supply path 57 for supplying the bubble generating chamber 56 with the liquid.

The bubble generating chamber 56 is constituted of a first bubble generating chamber 56*a* of which a bottom surface is constituted by the principal plane of the element substrate 11 and which communicates with the supply path 32 and serves to generate a bubble in the liquid contained therein by the heater 20, and a second bubble generating chamber 56*b* which is provided in communication with an upper aperture of the first bubble generating chamber 31*a* parallel to the principal plane of the element substrate 11 and in which the bubble generated in the first bubble generating chamber 31*a* grows. The discharge port portion 53 is provided in communication with an upper aperture of the second bubble generating chamber 56*b*, and a step difference is formed between a lateral wall surface of the discharge port portion 53 and a lateral wall surface of the second bubble generating chamber 56*b*.

The first bubble generating chamber 56*a* is formed with an approximately rectangular bottom surface opposed to the discharge port 53*a*. Also the first bubble generating chamber 56*a* is so formed that a shortest distance OH between a principal plane of the heater 20, parallel to the principal plane of the element substrate 11, and the discharge port 53*a* is 30 μm or less. As already explained with reference to FIG. 1, the heater 20 is arranged in plural units on the element substrate 11, with a pitch of about 42.5 μm in case of a density of array of 600 dpi. Also in case the first bubble generating chamber 56*a* is formed with a width of 35 μm in a direction of array of the heaters, a nozzle wall separating the heaters has a width of about 7.5 μm. The first bubble generating chamber 56*a* has a height of 10 μm from the surface of the element substrate 11. The second bubble generating chamber 56*b*, formed on the first bubble generating chamber 56*a*, has a height of 15 μm , and the discharge port portion 53 formed on the orifice substrate 52 has a height of 5 μm. The discharge port 56*a* has a circular shape, with a diameter of 15 μm. The second bubble generating chamber 56*b* has a truncated conical shape, and, in case a bottom surface connecting with the first bubble generating chamber 56*a* has a diameter of 30 μm and the lateral wall of the second bubble generating chamber has an inclination of 20°, the upper face at the side of the discharge port portion 53 has a diameter of 19 μm. It is connected, by a step difference of about 2 μm, with the discharge port portion 53 of a diameter of 15 μm.

The bubble generated in the first bubble generating chamber 56*a* grows toward the second bubble generating chamber 56*b* and the supply path 57, whereby the ink filled in the nozzle 54 is subjected to a flow rectification in the discharge port portion 53 and is made to fly from the discharge port 53*a* provided in the orifice substrate.

The supply path 57 communicates with the bubble generating chamber 56 at an end, and with the supply chamber 55 at the other end.

In the nozzle 54, an upper plane of the first bubble generating chamber 56*a*, parallel to the principal plane, and a first upper plane 59*a* parallel to the principal plane of the supply path 57 adjacent to the bubble generating chamber 56 are formed by a continuous same plane, which is connected, by a first step difference 58*a* inclined to the principal plane, to a second upper plane 59*b* positioned higher and parallel to the principal plane of the element substrate 11 and provided at a side of the supply path 57 toward the supply chamber 55, and which is further connected, by a second step difference 58*b* inclined to the principal plane, to a third upper plane 59*c* positioned higher than the second upper plane 59*b* and parallel to the principal plane of the element substrate 11 and provided at a side of the supply path 57 toward the supply chamber 55.

A structure from the first step difference 58*a* to the aperture at the bottom plane of the second bubble generating chamber 56*b* constitutes a control portion, which controls the ink flowing by the bubble in the bubble generating chamber 56.

In the control portion of the nozzle 54, as explained in the foregoing, the first upper plane 59*a*, constituting a portion from an end of the supply path adjacent to the first bubble generating chamber 56*a* to the first bubble generating chamber 56*a*, is formed with a smaller height to the principal plane of the element substrate 11 than a height of the second upper plane 59*b* of the supply path 57 adjacent at the side of the supply chamber 55, and the height of the second upper plane 59*b* is made smaller than the height of the third upper plane 59*c* of the supply path 57 adjacent at the side of the supply chamber 55. Consequently in the nozzle 54, because of the presence of the first upper plane 59*a*, the cross section of the ink flow path is made smaller in a portion from an end of the supply path 57 adjacent to the first bubble generating chamber 56*a* to the first bubble generating chamber 56*a* than in other portions of the flow path.

By giving a larger inclination to the lateral wall of the second bubble generating chamber 56*b* and also giving an inclination to the first bubble generating chamber 56*a*, it is possible to more efficiently move the ink filled in the nozzle toward the discharge port portion 53 by the bubble generated in the first bubble, generating chamber 56*a*. However, though the first bubble generating chamber 56*a*, the second bubble generating chamber 56*b* and the discharge port portion 53 are formed precisely with a photolithographic process, a complete formation without any aberration is not possible and there may result an alignment error of a submicron order. Therefore, in order to cause a straight flight of the ink in a direction perpendicular to the principal plane of the element substrate 11, it is necessary to rectify the ink flying direction at the discharge port portion 53. For this purpose, the lateral wall of the discharge port portion 53 is preferably as parallel as possible to the direction perpendicular to the principal plane of the element substrate 11, namely having an inclination as close as possible to 0°.

On the other hand, the aperture of the discharge port should be made smaller in order to obtain a smaller flying ink droplet, and, in case the height (length) of the discharge port portion 53 thus becomes larger than the aperture, the viscosity resistance of the ink in such portion increases significantly, thereby leading to a deterioration of the ink discharge characteristics. Therefore, the liquid discharge head 2 of the second embodiment has such a configuration as to facilitate growth of the bubble, generated in the first bubble generating chamber, to the second bubble generating chamber, also to improve the flowability of the ink, filled in the nozzle, in the second bubble generating chamber and also to achieve a rectifying effect on the discharge direction of the flying ink. The height of the second bubble generating chamber, though dependent also on the distance from the surface of the element substrate 11 to the discharge port 53*a*, is preferably about 3 to 25 μm, more preferably about 5 to 15 μm. Also the length of the discharge port portion 53 is preferably about 1 to 10 μm, more preferably about 1 to 3 μm.

Also as shown in FIG. 13, the nozzle 54 is formed in a straight shape having an almost constant width, perpendicular to the ink flowing direction and parallel to the principal plane of the element substrate 11, over a range from the supply chamber 55 to the bubble generating chamber 56. Furthermore, in the nozzle 54, internal wall planes opposed to the principal plane of the element substrate 11 are formed parallel thereto over a range from the supply chamber 55 to the bubble generating chamber 56.

In the following there will be explained an ink discharging operation in the liquid discharge head 2 of the above-described configuration.

At first, in the liquid discharge head 2, the ink supplied from the supply aperture 36 to the supply chamber 55 is supplied to the nozzles 54 of the first nozzle array and the second nozzle array. The ink supplied into each nozzle 54 flows along the supply path 57 and fills the bubble generating chamber 56. The ink filled in the bubble generating chamber 56 is made, by a growing pressure of a bubble generated by a film boiling induced by the heater 20, to fly in a direction substantially perpendicular to the principal plane of the element substrate 11, and is discharged as an ink droplet from the discharge port 53*a*.

At the discharge of the ink filled in the bubble generating chamber 56, a part of the ink therein flows toward the supply path 57 by the pressure of the bubble generated in the bubble generating chamber 56. In the liquid discharge head 2, the pressure of the bubble generated in the first bubble generating chamber 56*a* is immediately transmitted to the second bubble generating chamber 56*b*, whereby the ink filled in the first bubble generating chamber 56*a* and the second bubble generating chamber 56*b* move into the second bubble generating chamber 56*b*. In this state, the bubble growing in the first bubble generating chamber 56*a* and the second bubble generating chamber 56*b* satisfactorily grows toward the discharge port 53*a* with little pressure loss in contact with the internal walls, because of the inclinations thereof. Then the ink rectified in the discharge port portion 53*a* is made to fly, from the discharge port 53*a* formed in the orifice substrate 52, in a direction perpendicular to the principal plane of the element substrate 11. Also there is satisfactorily secured a discharge volume of the ink droplet. Therefore, the liquid discharge head 2 can achieve a higher discharge speed of the ink droplet discharged from the discharge port 53*a*.

Consequently, in comparison with a prior liquid discharge head, the liquid discharge head 2 can improve a kinetic energy of the ink droplet calculated from the discharge speed and the discharge volume, thereby improving the discharge efficiency. It can also achieve, as in the aforementioned liquid discharge head 1, a higher discharge frequency.

The liquid discharge head is associated with a drawback that the volume of the flying ink droplet fluctuates by an accumulation of heat, generated by the heaters, in the liquid discharge head, but the upper plane of the supply path, made higher toward the supply chamber, allows to increase the liquid amount in the supply path, thereby suppressing a temperature increase in the discharged liquid by heat conduction from the liquid of thus lower temperature, whereby the dependence of the discharge amount on the temperature can be improved.

In the following, there will be briefly explained a producing method for the liquid discharge head 2 of the above-described configuration. As the producing method of the liquid discharge head 2 is similar to that of the liquid discharge head 1, same components will be represented by same numbers and will not be explained further.

The producing method for the liquid discharge head 2 is executed according to the aforementioned method for the liquid discharge head 1.

A first step is, as shown in FIGS. 8A and 9A, a substrate forming step by forming plural heaters 20 and predetermined wirings for voltage application to such heaters 20 for example by a patterning process on a Si chip, thereby forming the element substrate 11.

A second step is, as shown in FIGS. 8B, 9B and 9C, a coating step for coating, by spin coating method on the element substrate 11, in succession a lower resin layer 42 and an upper resin layer 41 which undergo a destruction of chemical bonds in the molecule and become soluble under an irradiation with a DUV light of a wavelength not exceeding 330 nm. The lower resin layer 42 has a film thickness of 10 μm, and the upper resin layer 41 has a film thickness of 15 μm.

A third step is, as shown in FIGS. 8B and 9D, a pattern forming step of exposing the upper resin layer 41 to a NUV light of a wavelength region of about 260 to 330 nm, employing a DUV light irradiating exposure apparatus and mounting thereon a filter capable of intercepting the DUV light with a wavelength under 260 nm as wavelength selecting means thereby passing the light of a wavelength of 260 nm or longer, and then developing the resin layer, thereby forming a desired nozzle pattern in the upper resin layer 41. As a filter for intercepting the DUV light of a wavelength less than 260 nm, there can be employed a slit mask 105 having different slit pitches to arbitrarily set the height of the nozzle pattern, whereby the nozzle patterns of the second bubble generating chamber 56*b*, the second upper plane 59*b* and the third upper plane 59*c* can be formed with respectively different heights. Though not illustrated, the slit pitch of the slit mask 105 may be changed corresponding to the second upper plane 59*b* and the third upper plane 59*c* to obtain respectively different heights.

A fourth step executes, as shown in FIGS. 8B and 9D, a heating for 10 minutes at 140° C. on the upper resin layer 41 subjected to the pattern formation, thereby forming an inclination of an angle of 20° on a lateral face of the upper resin layer.

A fifth step is, as shown in FIGS. 8B and 9E, a pattern forming step of exposing and developing the lower resin layer 42 under an irradiation of a DUV light of a wavelength region of 210 to 330 nm by the aforementioned exposure apparatus with a mask 106, thereby forming a desired nozzle pattern in the lower resin layer 42.

A sixth step is, as shown in FIG. 10A, a coating step of coating a transparent covering resin layer 43 for constituting the orifice substrate 12, on the upper resin layer 41 and the lower resin layer 42 in which the nozzle patterns are formed and which are rendered soluble by the destruction of the crosslinking bonds in the molecule by the DUV irradiation. The coating resin layer 43 has a film thickness of 30 μm.

A seventh step executes, as shown in FIGS. 8C and 10B, an UV light irradiation on the covering resin layer 43 by an exposure apparatus, and eliminates a portion corresponding to the discharge port portion 53 by an exposure and a development, thereby forming the orifice substrate 52. The discharge port portion 53 has a length of 5 μm.

An eighth step executes, as shown in FIGS. 8D and 10C, a chemical etching or the like on the rear surface of the element substrate 11, thereby forming the supply aperture 36 in the element substrate 11. For the chemical etching, there can be employed, for example, an anisotropic etching employing a strongly alkaline solution (KOH, NaOH or TMAH).

A ninth step executes, as shown in FIGS. 8E and 10D, an irradiation of a DUV light of a wavelength of about 330 nm or shorter from the principal plane side of the element substrate 11 through the covering resin layer 43 thereby dissolving out the upper resin layer 41 and the lower resin layer 42, positioned between the element substrate 11 and the orifice substrate 52.

In this manner, there is obtained a chip provided with the nozzle 54 which includes the discharge port 53*a*, the supply aperture 36 and the upper planes 58*a*, 58*b*, 58*c* formed in stepped manner in the supply path 57 connecting these parts. A liquid discharge head 2 can be obtained by electrically connecting such chip with a wiring board (not shown) for driving the heaters 20.

In the liquid discharge head 2, as explained in the foregoing, the second bubble generating chamber 56*b* is provided in a truncated conical shape and the wall of the first bubble generating chamber 56*a* is also given an inclination in order to achieves a flow rectification in a direction from the element substrate 11 toward the discharge port 53*a* with a gradual decrease of the ink volume, whereby the liquid droplet flies in a direction perpendicular to the element substrate 11 in the vicinity of the discharge port 53*a*. Also the presence of the first upper plane 59*a* for controlling the ink flow in the bubble generating chamber 56 stabilizes the volume of the discharged ink droplet, thereby improving the ink droplet discharge efficiency, and the upper plane of the supply path, made higher toward the supply chamber, allows to increase the liquid amount in the supply path, thereby suppressing a temperature increase in the discharged liquid by heat conduction from the liquid of thus lower temperature, whereby the dependence of the discharge amount on the temperature can be improved and the discharge efficiency of the ink droplet can be elevated.

(Third Embodiment)

In the following there will be briefly explained, with reference to the accompanying drawings, a liquid discharge head 3 of a third embodiment, in which, in comparison with the aforementioned liquid discharge head 2, the first bubble generating chamber is made less higher and the second bubble generating chamber is made higher. In the liquid discharge head 3, components equivalent to those in the foregoing liquid discharge head 1 or 2 are represented by same numbers and will not be explained further.

In the liquid discharge head 3 of the third embodiment, as in the first embodiment, a bubble generating chamber 66 includes a first bubble generating chamber 66*a* in which a bubble is generated by the heater 20, and a second bubble generating chamber 66*b* positioned between the first bubble generating chamber 66*a* and a discharge port portion 63, and the lateral wall of the second bubble generating chamber 66*b* is constricted toward the discharge port portion 63, with an inclination of 10° to 45° with respect to a plane perpendicular to the principal plane of the element substrate 11. In addition, in the first bubble generating chamber 66*a*, wall surfaces provided for individually separating the plural first bubble generating chambers 66*a* arranged in an array are so inclined as to form a constriction toward the discharge port with an inclination angle of 0° to 10° with respect to a plane perpendicular to the principal plane of the element substrate 11, and such wall surfaces are so inclined, in the discharge port portion 63, as to form a constriction toward the discharge port 63*a* with an inclination angle of 0° to 5° with respect to a plane perpendicular to the principal plane of the element substrate 11.

Figure 15:
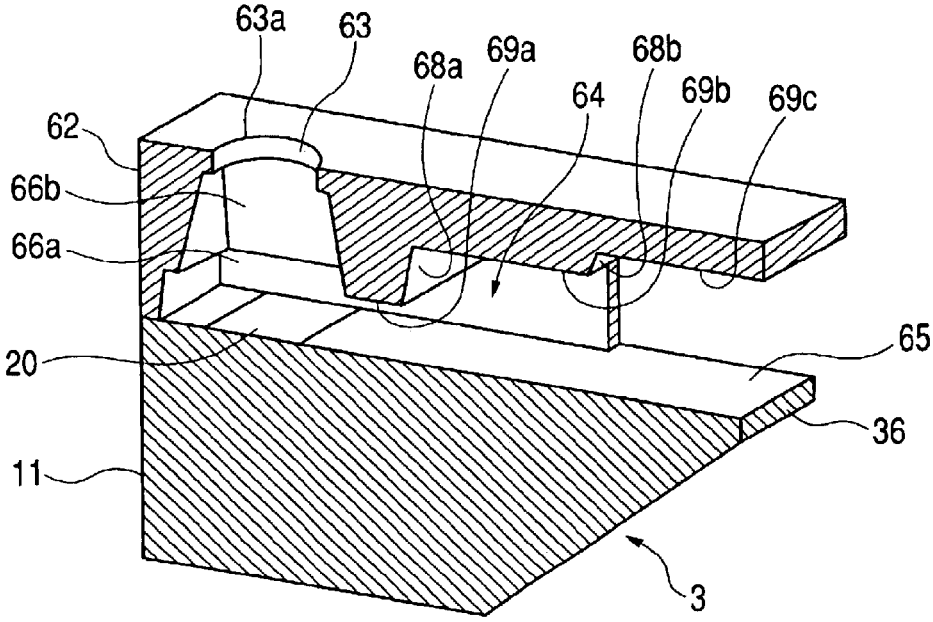
FIG. 15 is a partially cut-off perspective view showing a combination structure of a heater and a nozzle in a third embodiment of the liquid discharge head of the present invention.
Figure 16:
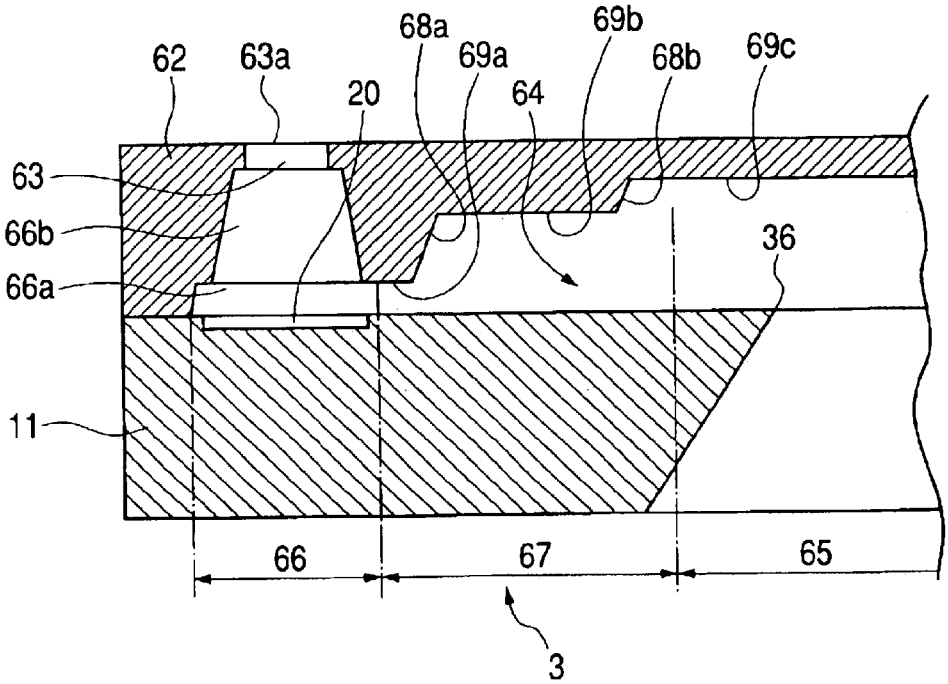
FIG. 16 is a lateral cross-sectional view showing a combination structure of a heater and a nozzle in a third embodiment of the liquid discharge head of the present invention.

As shown in FIGS. 15 and 16, an orifice substrate 62 provided with a liquid discharge head 3 is formed with a thickness of about 30 μm by a resinous material. As already explained in relation to FIG. 1, the orifice substrate 62 is provided with plural discharge ports 63 for discharging an ink droplet, also with plural nozzles 64 in which the ink flows and a supply chamber 65 for supplying such nozzles 64 with the ink.

The discharge port 63*a* is formed in a position opposed to the heater 20 formed on the element substrate 11, and is formed in a circular hole of a diameter for example of about 15 μm. Also, the discharge port 63 may be formed in a substantially star-like shape with radially pointed ends, according to the required discharge characteristics.

The first bubble generating chamber 66*a* is formed with an approximately rectangular bottom surface opposed to the discharge port 63*a*. Also the first bubble generating chamber 66*a* is so formed that a shortest distance OH between a principal plane of the heater 20, parallel to the principal plane of the element substrate 11, and the discharge port 63*a* is 30 μm or less. The first bubble generating chamber 66*a* has a height for example of 8 μm from the surface of the element substrate 11, and the second bubble generating chamber 66*b*, formed on the first bubble generating chamber 66*a*, has a height of 18 μm. The second bubble generating chamber 66*b* has a truncated square pyramidal shape having a side length of 28 μm at a side of the first bubble generating chamber 66*a* with rounded corners of a radius of 2 μm. Lateral walls of the second bubble generating chamber 66*b* are inclined by 15°, with respect to a plane perpendicular to the principal plane of the element substrate 11, so as to form a constriction toward the discharge port 63. The upper plane of the second bubble generating chamber 66*b* and the discharge port portion 63 of a diameter of 15 μm are connected across a step difference of about 1.7 μm at minimum.

The discharge port portion 63, formed in the orifice substrate 62, has a height of 4 μm. The discharge port 63 is circular with a diameter of 15 μm.

The bubble generated in the first bubble generating chamber 66*a* grows toward the second bubble generating chamber 66*b* and the supply path 67, whereby the ink filled in the nozzle 64 is subjected to a flow rectification in the discharge port portion 63 and is made to fly from the discharge port 63*a* provided in the orifice substrate 62.

The supply path 67 communicates with the bubble generating chamber 66 at an end, and with the supply chamber 65 at the other end. In the nozzle 64, an upper plane of the first bubble generating chamber 66*a*, parallel to the principal plane, and a first upper plane 69*a* parallel to the principal plane of the supply path 67 adjacent to the bubble generating chamber 66 are formed by a continuous same plane, which is connected, by a first step difference 68*a* inclined to the principal plane, to a second upper plane, 69*b* positioned higher and parallel to the principal plane of the element substrate 11 and provided at a side of the supply path 67 toward the supply chamber 65, and which is further connected, by a second step difference 68*b* inclined to the principal plane, to a third upper plane 69*c* positioned higher than the second upper plane 69*b* and parallel to the principal plane of the element substrate 11 and provided at a side of the supply path 67 toward the supply chamber 65.

The first bubble generating chamber 66*a* is formed on the element substrate 11. By reducing its height, the cross section of the ink flow path is made smaller in a portion from an end of the supply path 67 adjacent to the first bubble generating chamber 66*a* to the first bubble generating chamber 66*a*, and is rendered smaller than the cross section than in the nozzle 54 of the liquid discharge head 2 of the second embodiment.

On the other hand, by increasing the height of the second bubble generating chamber 66*b*, the bubble generated in the first bubble generating chamber 66*a* is more easily transmitted to the second bubble generating chamber 66*b*, but less transmitted to the supply path 67 connected to the first bubble generating chamber 66*a*, whereby the ink movement to the discharge port portion 63 can be achieved promptly and efficiently.

Also the nozzle 64 is formed in a straight shape having an almost constant width, perpendicular to the ink flowing direction and parallel to the principal plane of the element substrate 11, over a range from the supply chamber 65 to the bubble generating chamber 66. Furthermore, in the nozzle 64, internal wall planes opposed to the principal plane of the element substrate 11 are formed parallel thereto over a range from the supply chamber 65 to the bubble generating chamber 66.

In the following there will be explained an ink discharging operation in the liquid discharge head 3 of the above-described configuration.

At first, in the liquid discharge head 3, the ink supplied from the supply aperture 36 to the supply chamber 65 is supplied to the nozzles 64 of the first nozzle array and the second nozzle array. The ink supplied into each nozzle 64 flows along the supply path 67 and fills the bubble generating chamber 66. The ink filled in the bubble generating chamber 66 is made, by a growing pressure of a bubble generated by a film boiling induced by the heater 20, to fly in a direction substantially perpendicular to the principal plane of the element substrate 11, and is discharged as an ink droplet from the discharge port 63.

At the discharge of the ink filled in the bubble generating chamber 66, a part of the ink therein flows toward the supply path 67 by the pressure of the bubble generated in the first bubble generating chamber 66*a*. In the liquid discharge head 3, when a part of the ink in the first bubble generating chamber 66*a* flows toward the supply path 67, the smaller height of the first bubble generating chamber 66*a* constricting the flow path in the supply path 67 increases a fluid resistance therein against the ink flowing from the first bubble generating chamber 66*a* toward the supply chamber 65 through the supply path 67. In the liquid discharge head 3, because of such further suppression on the flow of the ink from the bubble generating chamber 66 toward the supply path 67, the bubble growth from the first bubble generating chamber 66*a* toward the second bubble generating chamber 66*b* is further enhanced, and the ink flow toward the discharge port is further facilitated to more satisfactorily secure the ink discharge volume.

Also in the liquid discharge head 3, the bubble pressure is more efficiently transmitted from the first bubble generating chamber 66*a* to the second bubble generating chamber 66*b*, and the inclined walls of the first bubble generating chamber 66*a* and the second bubble generating chamber 66*b* suppresses a pressure loss of the bubble, growing in the first bubble generating chamber 66*a* and the second bubble generating chamber 66*b* in contact with such wall, whereby the bubble grows satisfactorily. Consequently the liquid discharge head 3 can improve the discharge speed of the ink discharged from the discharge port 63.

In the above-described liquid discharge head 3, the ink movement in the first bubble generating chamber 66*a* and the second bubble generating chamber 66*b* can be executed more promptly and with less resistance. Also a reduced length of the discharge port portion enables a more prompt ink rectifying effect in comparison with the liquid discharge head 1 or 2, thereby further improving the discharge efficiency of the ink droplet, and the upper plane of the supply path, made higher toward the supply chamber, allows to increase the liquid amount in the supply path, thereby suppressing a temperature increase in the discharged liquid by heat conduction from the liquid of the lower temperature, whereby the dependence of the discharge amount on the temperature can be improved.

(Fourth Embodiment)

In the foregoing liquid discharge heads 1 to 3, the nozzles in the first nozzle array 16 and in the second nozzle array 17 are formed equally. In the following there will be explained, with reference to accompanying drawings, a liquid discharge head 4 of a fourth embodiment in which the first nozzle array and the second nozzle array have different nozzle shapes and heater areas.

Figure 17A:
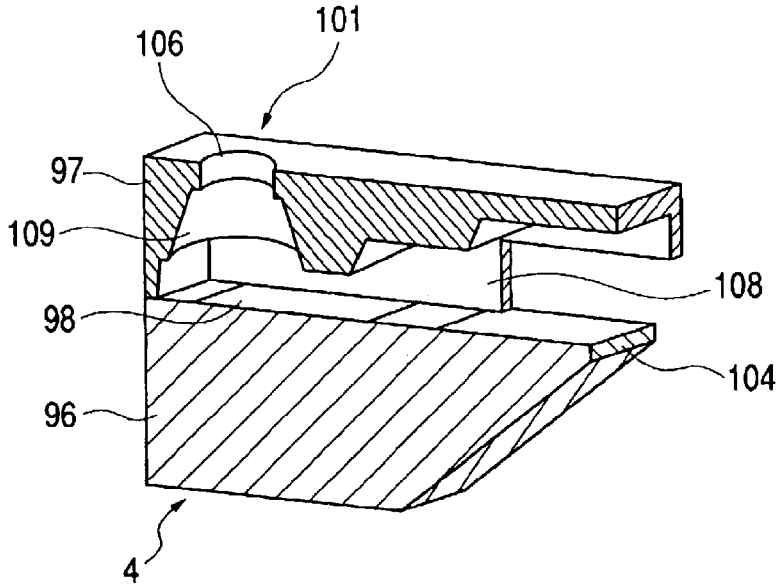
Figure 17B:
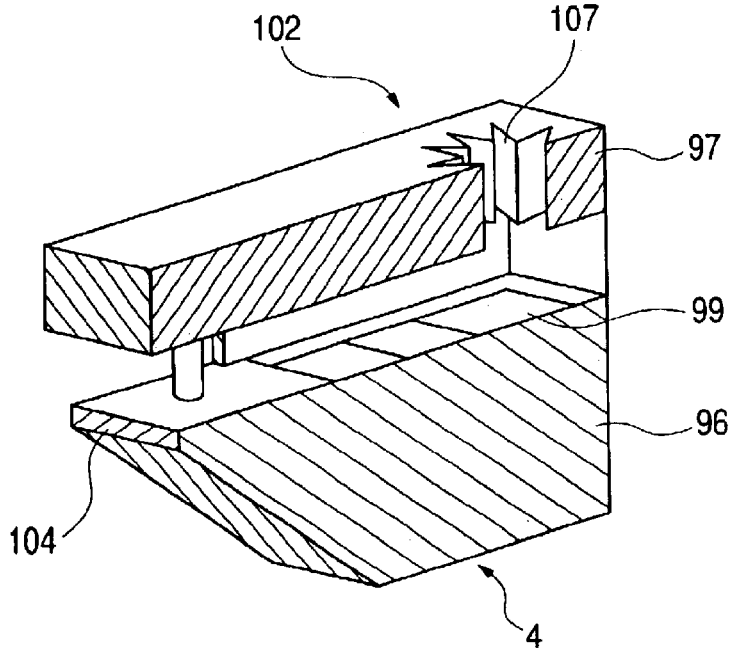

As shown in FIGS. 17A and 17B, on an element substrate 96 in the liquid discharge head 4, there are provided first heaters 98 and second heaters 99 which have mutually different areas parallel to the principal plane of element substrate.

Also in an orifice substrate 97 of the liquid discharge head 4, discharge ports 106, 107 for the first and second nozzle arrays are formed with mutually different aperture areas and mutually different nozzle shapes. Each discharge port 106 of the first nozzle array 101 is formed as a circular hole. Each nozzle in the first nozzle array 101 will not be explained further as it has a configuration same as in the aforementioned liquid discharge head 2, but a second bubble generating chamber 109 is provided on the first bubble generating chamber in order to improve the ink flow in the bubble generating chamber. Also each discharge port 107 of the second nozzle array 102 is formed into a substantially star shape with radially extending points. Each nozzle in the second nozzle array 102 is formed into a straight shape without a change in the cross section of the ink flow path from the bubble generating chamber to the discharge port.

In the element substrate 96, there is provided a supply aperture 104 for supplying the ink to the first nozzle array 101 and the second nozzle array 102.

The ink flow in the nozzle is induced by a volume Vd of the ink droplet flying from the discharge port, and, after a flight of an ink droplet, a meniscus returning effect is executed by a capillary force generated corresponding to the aperture area of the discharge port. The capillary force p is represented by an aperture area $S_0$ of the discharge port, an external peripheral length $L_1$ of the periphery of the discharge port, a surface tension γ of the ink and a contact angle θ of the ink with the internal wall of the nozzle, as follows:

$$p=\gamma\cdot\cos\theta\times L_1/S_0.$$

Also by assuming that the meniscus is solely generated by the volume Vd of the flying ink droplet and returns after a cycle time t of the discharge frequency (refill time t), there stands a relation:

$$p=B\times(Vd/t).$$

The liquid discharge head 4 can discharge ink droplets of different discharge volumes from a single head, as a result of mutually different areas of the first heater 98 and the second heater 99 and mutually different aperture areas of the discharge ports 106, 107 in the first nozzle array 101 and in the second nozzle array 102.

Also in the liquid discharge head 4, the inks discharged from the first nozzle array 101 and the second nozzle array 102 have same physical properties such as surface tension, viscosity and pH, and it is rendered possible to obtain approximately same discharge frequency responses in the first nozzle array 101 and the second nozzle array 102 by selecting the inertance A and the viscosity resistance B according to the nozzle structure, in accordance with the discharge volume of the ink droplets discharged from the discharge ports 106 and 107.

More specifically, in the liquid discharge head 4, in case of selecting ink droplet discharge amount of 4.0 (pl) and 1.0 (pl) respectively for the first nozzle array 101 and the second nozzle array 102, a substantially same refill time t can be obtained in the nozzle arrays 101 and 102, by selecting substantially equal values for the ratio L1/S0 between the aperture peripheral length L1 and the aperture area S0 of the discharge port 106 or 107, and the viscosity resistance B.

In the following there will be explained, with reference to the accompanying drawings, a method for producing the liquid discharge head 4 of the above-described configuration.

Figure 18A:
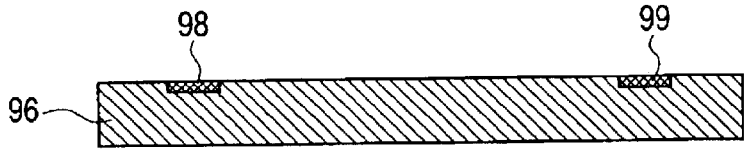
Figure 18B:
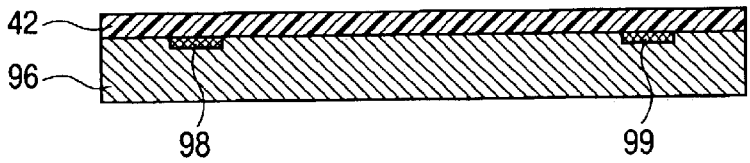
Figure 18C:
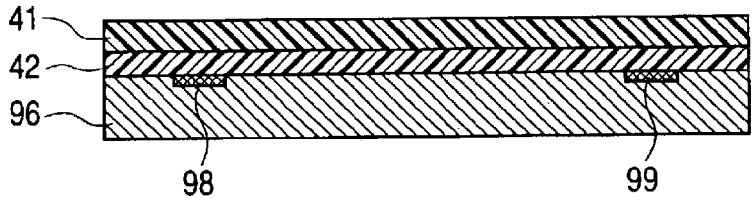
Figure 18D:
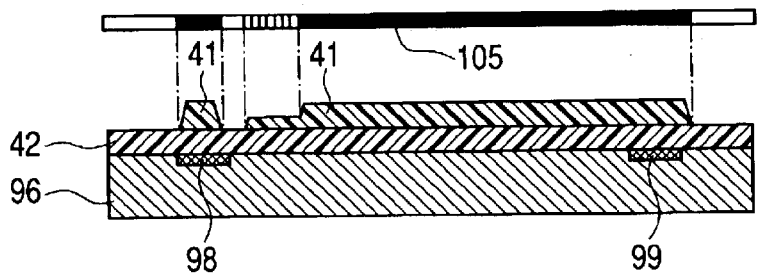
Figure 18E:
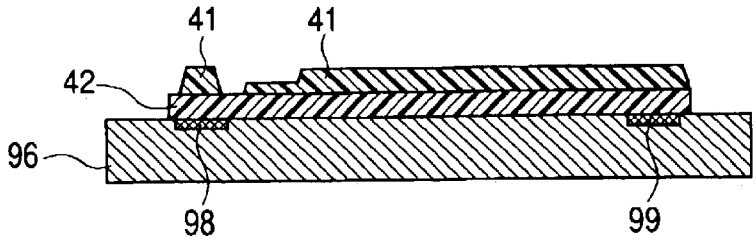
Figure 19A:
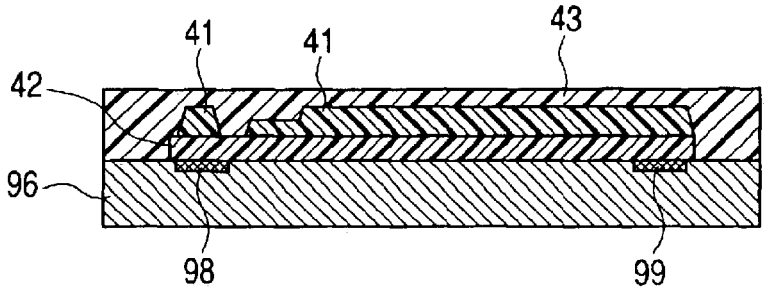
Figure 19B:
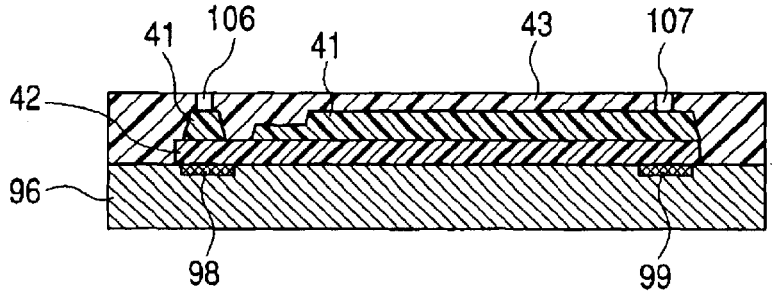
Figure 19C:
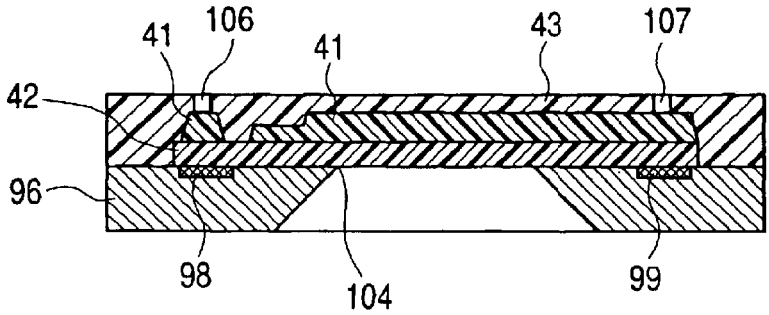
Figure 19D:
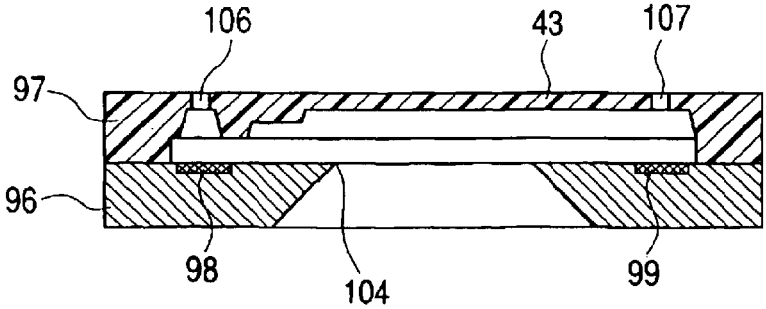

The producing method for the liquid discharge head 4 is similar to the aforementioned producing method for the liquid discharge head 1 or 2, and steps of the producing method are same except for pattern forming steps of forming nozzle patterns in the upper resin layer 41 and the lower resin layer 42. In the producing method of the liquid discharge head 4, the pattern forming steps are executed, as shown in FIGS. 18A, 18B and 18C, by forming the upper resin layer 41 and the lower resin layer 42 on the element substrate 96, and, as shown in FIGS. 18D and 18E, by forming desired nozzle patterns respectively for the first nozzle array 101 and the second nozzle array 102. More specifically, the nozzle patterns of the first nozzle array 101 and the second nozzle array 102 are formed asymmetrically with respect to the supply aperture 104. In such producing method, the liquid discharge head 4 can be formed easily by only partially changing the shapes of the nozzle patterns in the upper resin layer 41 and the lower resin layer 42. Subsequently steps shown in FIGS. 19A to 19D are same as those explained in the first embodiment and will not be explained further.

In the liquid discharge head 4 explained in the foregoing, by forming mutually different nozzle structures in the first nozzle array 101 and the second nozzle array 102, it is rendered possible to discharge ink droplets of mutually different discharge volumes respectively from the first nozzle array 101 and the second nozzle array 102, and it is also easily possible to discharge the ink droplets in stable manner at an increased optimum discharge frequency.

Also in the liquid discharge head 4, by adjusting the balance of the viscosity resistance by the capillary force, it is rendered possible to uniformly and promptly suck the ink in a recovery operation by a recovery mechanism, and also to simplify the recovery mechanism, whereby the liquid discharge head can be improved in the reliability of the discharge characteristics and there can be provided a recording apparatus with an improved reliability in the recording operation.

In the liquid discharge head of the present invention, as explained in the foregoing, by efficiently transmitting the bubble generated in the first bubble generating chamber to the second bubble generating chamber, it is possible to increase the discharge speed of the liquid droplet discharged from the discharge port, and to stabilize the discharge amount of the discharged liquid droplet. Consequently such liquid discharge head can improve the discharge efficiency of the liquid droplet.

Also the liquid discharge head of the present invention, by suppressing the pressure loss, in the bubble generated in the first bubble generating chamber, resulting from the contact with the internal wall of the second bubble generating chamber, can achieve a faster and more efficient ink flow in the bubble generating chamber, thereby achieving a higher discharge speed and a stabler discharge amount of the liquid droplet discharged from the discharge port and also achieving a faster refilling speed.

Furthermore, the upper plane of the supply path, positioned higher toward the supply chamber, allows to increase the liquid amount in the supply path, and to suppress a temperature increase in the discharged liquid by the temperature conduction from the liquid of lower temperature, thereby improving the temperature dependence of the discharge amount and the discharge efficiency of the ink droplet.

What is claimed is:

1. A method for producing a liquid discharge head including a discharge energy generating element for generating energy for discharging a liquid droplet; an element substrate provided with said discharge energy generating element on a principal plane thereof; and an orifice substrate provided with a discharge port portion including a discharge port for discharging a liquid droplet, a bubble generating chamber for generating a bubble in a liquid therein by said discharge energy generating element, a nozzle including a supply path for supplying said bubble generating chamber with the liquid, and a supply chamber for supplying said nozzle with the liquid, and adjoined to the principal plane of said element substrate, the method comprising the steps of:

coating, on the element substrate in which said discharge energy generating element is provided on the principal plane, a solvent-soluble thermally cross-linkable organic resin for forming a pattern of a first bubble generating chamber and a first flow path and heating the resin thereby forming a thermally cross-linked film;

coating, on said thermally cross-linked film, a solvent-soluble organic resin for forming a pattern of a second bubble generating chamber and a second flow path;

forming, in said organic resin, a second flow path pattern of a smaller height than in said second bubble generating chamber simultaneously with a pattern of said second bubble generating chamber, by employing a locally different exposure amount;

laminating a negative-working organic resin layer on said thermally cross-linked film and said patterned organic resin and forming said discharge port portion in said negative-working organic resin layer; and removing said thermally cross-linked film and said patterned organic resin, wherein the pattern of the second flow path having a lower height than in said second bubble generating chamber is formed by an exposure of said organic resin, employing a slit mask having a slit pitch and then developing said organic resin.

2. The method for producing a liquid discharge head according to claim 1, wherein said second flow path pattern is formed with two or more step differences by exposing and developing said organic resin, utilizing a mask having different slit pitches.

3. A method for producing a liquid discharge head including a discharge energy generating element for generating energy for discharging a liquid droplet; an element substrate provided with said discharge energy generating element on a principal plane thereof; and an orifice substrate provided with a discharge port portion including a discharge port for discharging a liquid droplet, a bubble generating chamber for generating a bubble in a liquid therein by said discharge energy generating element, a nozzle including a supply path for supplying said bubble generating chamber with the liquid, and a supply chamber for supplying said nozzle with the liquid, and adjoined to the principal plane of said element substrate, the method comprising the steps of:

coating, on the element substrate in which said discharge energy generating element is provided on the principal plane, a solvent-soluble thermally cross-linkable organic resin for forming a pattern of a first bubble generating chamber and a first flow path and heating the resin thereby forming a thermally cross-linked film;

coating, on said thermally cross-linked film, a solvent-soluble organic resin for forming a pattern of a second bubble generating chamber and a second flow path;

forming, in said organic resin, a second flow path pattern of a smaller height than in said second bubble generating chamber simultaneously with a pattern of said second bubble generating chamber, by employing a locally different exposure amount;

laminating a negative-working organic resin layer on said thermally cross-linked film and said patterned organic resin and forming said discharge port portion in said negative-working organic resin layer; and removing said thermally cross-linked film and said patterned organic resin, wherein the pattern of said second bubble generating chamber and said second flow path are formed, after an exposure-development step through a mask, by formation of an inclination of 10° to 45° by the application of a temperature.

4. A method for producing a liquid discharge head including a discharge energy generating element for generating energy for discharging a liquid droplet; an element substrate provided with said discharge energy generating element on a principal plane thereof; and an orifice substrate provided with a discharge port portion including a discharge port for discharging a liquid droplet, a bubble generating chamber for generating a bubble in a liquid therein by said discharge energy generating element, a nozzle including a supply path for supplying said bubble generating chamber with the liquid, and a supply chamber for supplying said nozzle with the liquid, and adjoined to the principal plane of said element substrate, the method comprising the steps of:

coating, on the element substrate in which said discharge energy generating element is provided on the principal plane, a solvent-soluble thermally cross-linkable organic resin for forming a pattern of a first bubble generating chamber and a first flow path and heating the resin thereby forming a thermally cross-linked film;

coating, on said thermally cross-linked film, a solvent-soluble organic resin for forming a pattern of a second bubble generating chamber and a second flow path;

exposing and developing said organic resin employing a slit mask having partially different slit pitches and a near-UV light, in order to form a pattern of said second bubble generating chamber and a second flow path having different plural heights;

heating said organic resin, subjected to the pattern formation by exposure and development, at a temperature not exceeding a glass transition point to thereby form an inclination of 10° to 45°;

exposing and developing said thermally cross-linked film employing a deep-UV light of a region of 200 to 300 nm;

coating, exposing, developing and heating a negative-working organic resin on the flow path pattern formed by said two-layered solvent-soluble film, thereby laminating said orifice substrate having said discharge port portion; and irradiating, through said orifice substrate, the underlying two-layered organic resin for forming the flow path with a deep-UV light, followed by removal with a solvent, thereby forming said orifice substrate including said discharge port portion for discharging a liquid droplet, said bubble generating chamber in which the bubble is generated by said discharge energy generating element, said nozzle having said supply path for supplying said bubble generating chamber with the liquid, and said supply chamber for supplying said nozzle with the liquid, and adjoined to the principal plane of said element substrate.

5. The producing method for a liquid discharge head according to claim 4, wherein said first flow path is formed with a height of 5 to 20 $\mu$m on said element substrate and with an inclination of 0° to 10° with respect to a plane perpendicular to the principal plane of said element substrate.

* * * * *